US010857476B2

(12) United States Patent
Wong et al.

(10) Patent No.: US 10,857,476 B2
(45) Date of Patent: Dec. 8, 2020

(54) BUILDING BLOCK AND BUILDING BLOCK ASSEMBLIES

(71) Applicant: BODAK BLOCKS LIMITED, Hong Kong (HK)

(72) Inventors: Yeung Wong, Hong Kong (HK); Tang Chan, Hong Kong (HK)

(73) Assignee: BODAK BLOCKS LIMITED, Hong Kong (HK)

( * ) Notice: Subject to any disclaimer, the term of this patent is extended or adjusted under 35 U.S.C. 154(b) by 0 days.

(21) Appl. No.: 16/337,442

(22) PCT Filed: Sep. 28, 2017

(86) PCT No.: PCT/IB2017/055947
§ 371 (c)(1),
(2) Date: Mar. 28, 2019

(87) PCT Pub. No.: WO2018/060908
PCT Pub. Date: Apr. 5, 2018

(65) Prior Publication Data

US 2020/0038772 A1 Feb. 6, 2020

(30) Foreign Application Priority Data

Sep. 28, 2016 (HK) ..... 16111359.4
Dec. 8, 2016 (HK) ..... 16114032.3

(51) Int. Cl.
*A63H 33/08* (2006.01)
*A63H 33/06* (2006.01)
*A63H 33/10* (2006.01)

(52) U.S. Cl.
CPC ..... *A63H 33/086* (2013.01); *A63H 33/062* (2013.01); *A63H 33/107* (2013.01)

(58) Field of Classification Search
CPC ..... A63H 33/04; A63H 33/06; A63H 33/062; A63H 33/08; A63H 33/086; A63H 33/088; A63H 33/10; A63H 33/101; A63H 33/107
(Continued)

(56) References Cited

U.S. PATENT DOCUMENTS 2,791,868 A * 5/1957 Viken ..... A63H 33/062 446/107
3,242,610 A * 3/1966 Christiansen ..... A63H 33/108 446/128
(Continued)

FOREIGN PATENT DOCUMENTS

CN 103432752 A 12/2013
CN 203342380 U 12/2013
CN 203777674 U 8/2014

OTHER PUBLICATIONS

International Search Report for PCT Patent Application No. PCT/IB2017/055947 dated Jan. 18, 2018.

*Primary Examiner* — Alexander R Niconovich

(57) ABSTRACT

A building block assembly comprising a first building block and a second building block which are in snap-fit engagement and which cooperate to define a building block receptacle for receiving and retaining a third building block, wherein the first building block comprises a first main body including two lateral portions and a bridging portion interconnecting the two lateral portions, wherein the two lateral portions and the first bridging portion cooperate to define a first partial receptacle having a first partial receptacle wall, and the two lateral portions cooperate to define a first connection surface on which a plurality of snap connectors is distributed; wherein the second building block comprises a second main body including two lateral portions and a bridging portion interconnecting the two lateral portions.

20 Claims, 8 Drawing Sheets

Figure 7A:
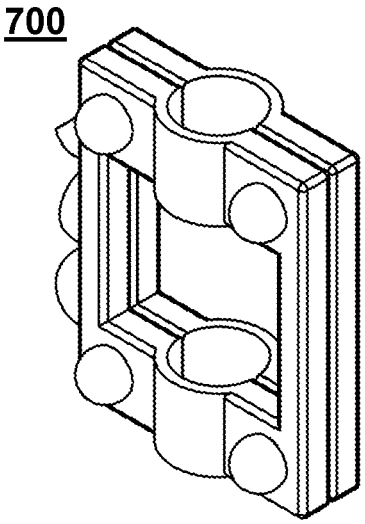

(58) Field of Classification Search
USPC ..... 446/85, 108, 120, 122, 124, 125, 128
See application file for complete search history.

(56) References Cited

U.S. PATENT DOCUMENTS

| | | | | | |
|---|---|---|---|---|---|
| 3,604,145 | A * | 9/1971 | Zimmerman | A63H 33/065 | 446/108 |
| 3,670,449 | A * | 6/1972 | Lemkin | A63H 33/088 | 446/102 |
| 4,214,403 | A * | 7/1980 | Knudsen | A63H 33/042 | 446/104 |
| 4,731,041 | A * | 3/1988 | Ziegler | A63H 33/065 | 446/115 |
| 4,992,069 | A * | 2/1991 | Bolli | A63H 33/086 | 446/128 |
| 5,104,345 | A * | 4/1992 | Lyman | A63H 33/10 | 446/101 |
| 5,304,086 | A * | 4/1994 | Bolli | A63H 33/042 | 446/104 |
| 5,645,463 | A * | 7/1997 | Olsen | A63H 33/04 | 446/104 |
| 5,683,283 | A * | 11/1997 | Glynn | A63H 33/086 | 446/128 |
| 5,788,555 | A * | 8/1998 | Glynn | A63H 33/10 | 446/124 |
| 5,938,498 | A * | 8/1999 | Glynn | A63H 33/10 | 446/124 |
| 5,951,356 | A * | 9/1999 | Cyrus | A63H 18/00 | 446/110 |
| 6,132,276 | A * | 10/2000 | Leemon | B63B 7/04 | 441/129 |
| 6,142,847 | A * | 11/2000 | Rudy | A63H 19/30 | 446/122 |
| 6,200,187 | B1 * | 3/2001 | Olsen | A63H 33/04 | 446/120 |
| 6,478,649 | B1 * | 11/2002 | Hoback | A63H 33/06 | 446/126 |
| 6,592,421 | B1 * | 7/2003 | Clever | A63H 33/082 | 446/108 |
| 7,841,923 | B2 * | 11/2010 | Marzetta | A63H 17/262 | 446/466 |
| 8,109,803 | B2 * | 2/2012 | Kichijo | A63H 33/108 | 446/109 |
| 8,197,297 | B2 * | 6/2012 | Shimizu | A63H 33/12 | 446/114 |
| 8,403,723 | B1 * | 3/2013 | Haner | A63H 23/005 | 446/120 |
| 8,435,095 | B1 * | 5/2013 | Abbas | A63H 33/105 | 446/122 |
| 8,628,374 | B2 * | 1/2014 | McDonald | A63H 33/086 | 446/128 |
| 8,991,131 | B1 * | 3/2015 | Lu | A63H 33/062 | 52/645 |
| 9,308,464 | B1 * | 4/2016 | Torres | A63H 33/044 | |
| 9,345,982 | B2 * | 5/2016 | Farco | A63H 33/10 | |
| 9,480,931 | B1 * | 11/2016 | Samo | A63H 33/086 | |
| 9,937,433 | B2 * | 4/2018 | Stolten | A63H 33/101 | |
| 10,029,187 | B2 * | 7/2018 | Liu | A63H 33/084 | |
| 10,086,310 | B2 * | 10/2018 | Semling | A63H 33/102 | |
| 10,159,905 | B2 * | 12/2018 | Bagley | A63H 33/086 | |
| 10,478,742 | B2 * | 11/2019 | Beaulieu | A63H 33/12 | |
| 10,518,193 | B2 * | 12/2019 | You | A63H 33/107 | |
| 10,537,820 | B2 * | 1/2020 | Dawes | A63H 33/26 | |
| 10,576,391 | B1 * | 3/2020 | Tong | A63H 33/086 | |
| 10,661,193 | B2 * | 5/2020 | Chiang | A63H 23/10 | |
| 2003/0104755 | A1 * | 6/2003 | Garpow | A63H 33/08 | 446/75 |
| 2006/0025034 | A1 * | 2/2006 | Slocum | A63H 33/065 | 446/119 |
| 2010/0151765 | A1 * | 6/2010 | Kwak | A63H 33/08 | 446/124 |
| 2015/0260206 | A1 * | 9/2015 | Acerra | A63H 33/105 | 403/364 |
| 2015/0298019 | A1 * | 10/2015 | Sokolov | A63H 33/084 | 446/124 |
| 2017/0340981 | A1 * | 11/2017 | Iliovits | A63H 33/086 | |
| 2019/0118109 | A1 * | 4/2019 | Simonds | A63H 33/086 | |
| 2019/0170173 | A1 * | 6/2019 | Aboud | F16B 5/07 | |
| 2019/0192987 | A1 * | 6/2019 | Wakim | A63H 33/086 | |
| 2019/0358557 | A1 * | 11/2019 | Semling | A63H 33/086 | |
| 2019/0358558 | A1 * | 11/2019 | Barwald | A63H 33/086 | |
| 2020/0054957 | A1 * | 2/2020 | Chan | A63H 33/08 | |

* cited by examiner

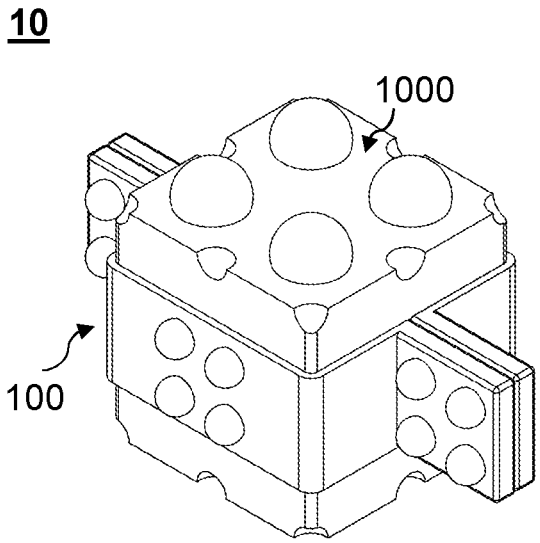
Fig. 1
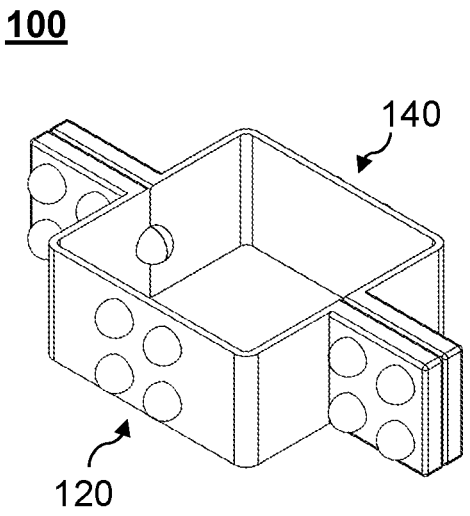
Fig. 1A
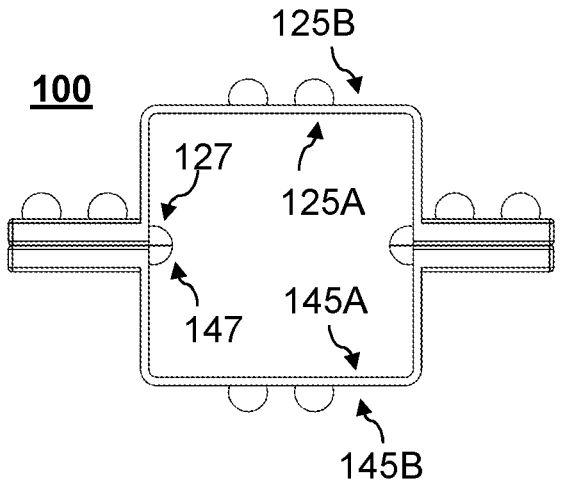
Fig. 1A1
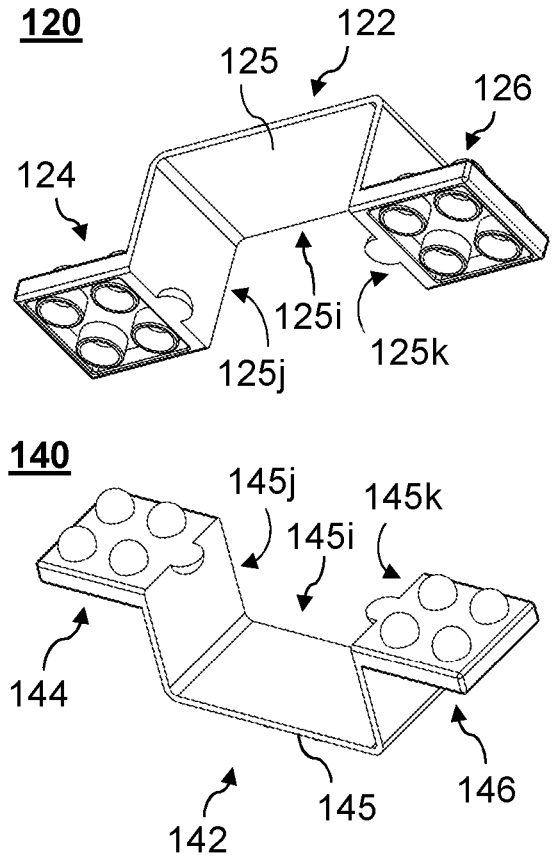
Fig. 1A2

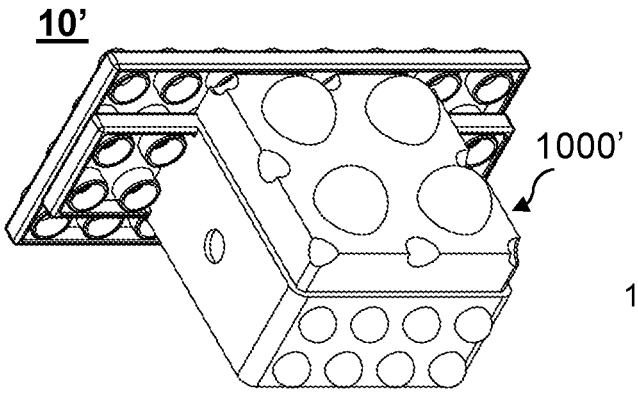
Fig. 1B
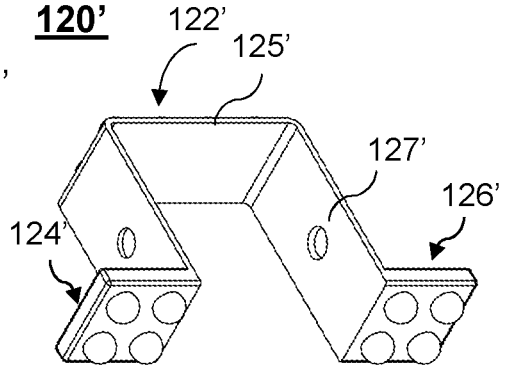
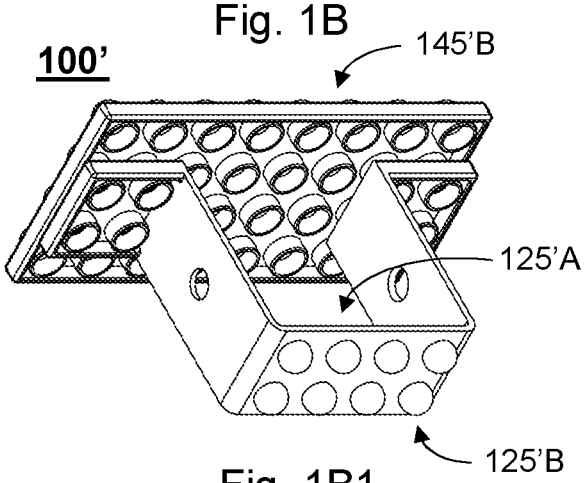
Fig. 1B1
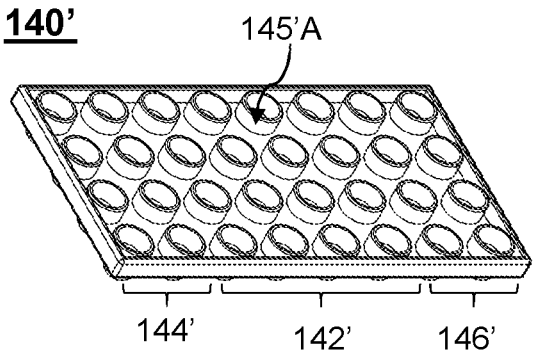
Fig. 1B2
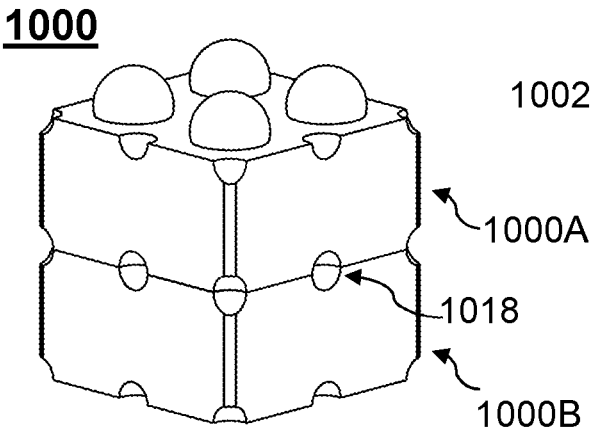
Fig. 1C
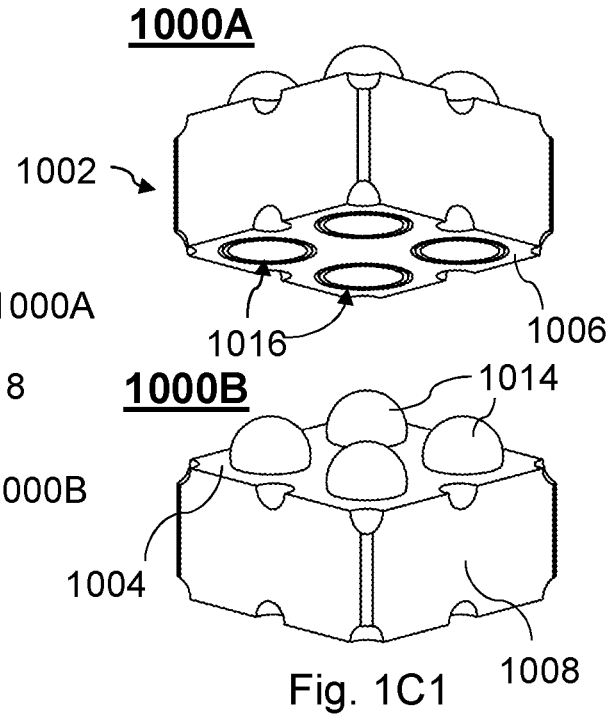
Fig. 1C1

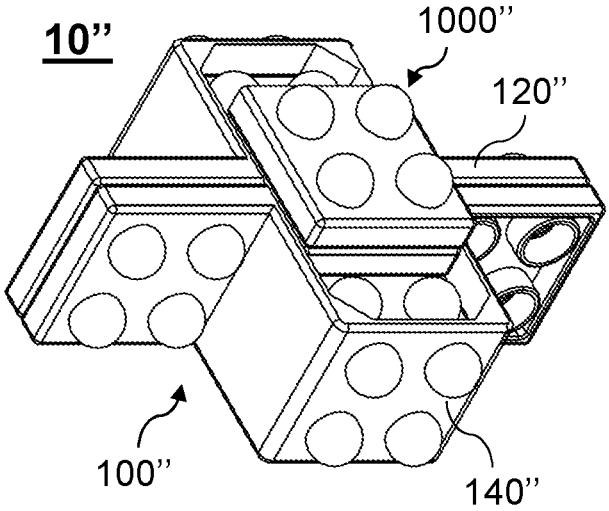
Fig. 1D
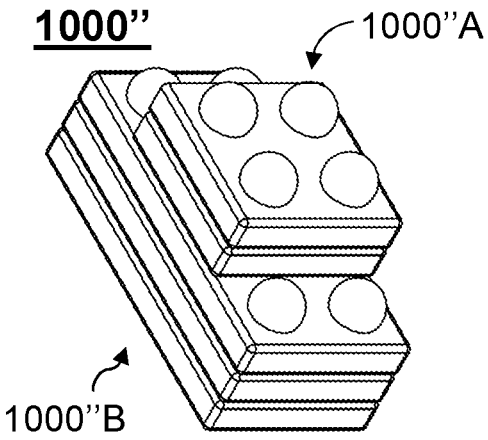
Fig. 1D1
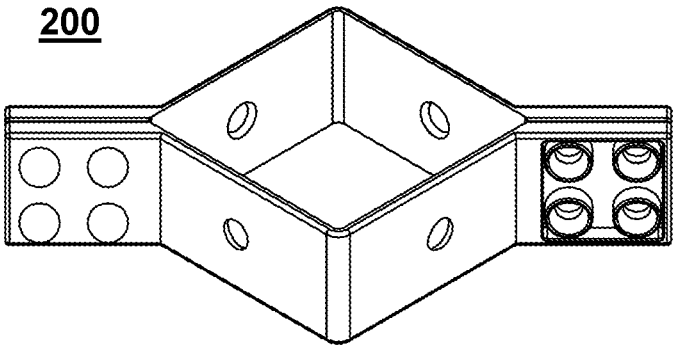
Fig. 2A
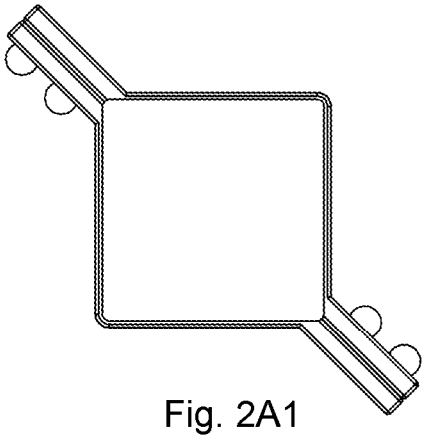
Fig. 2A1
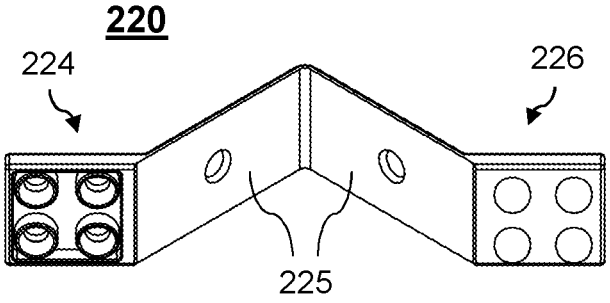
Fig. 2A2

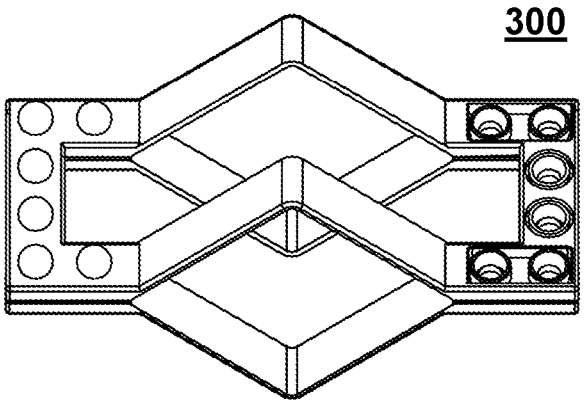
Fig. 3A
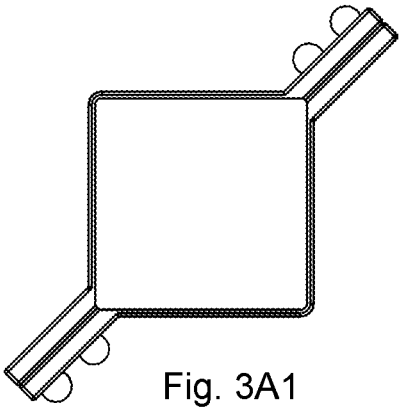
Fig. 3A1
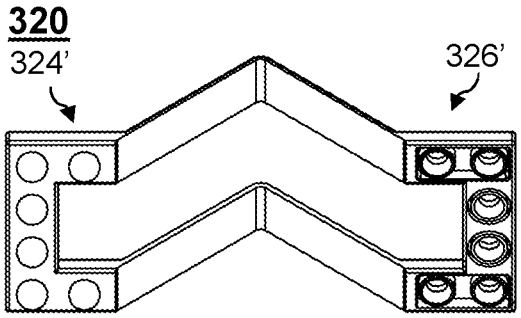
Fig. 3A2
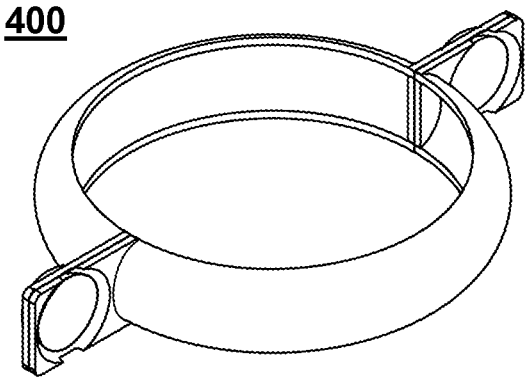
Fig. 4A
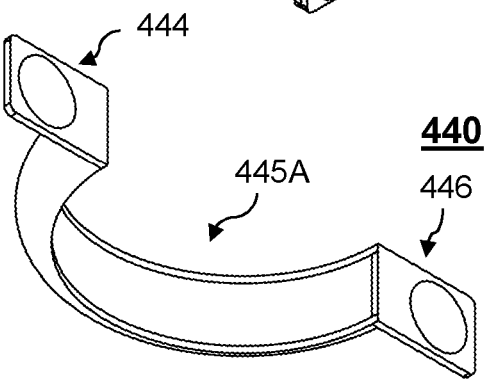
Fig. 4A1
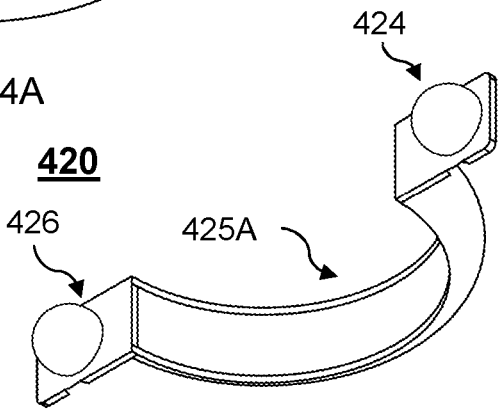
Fig. 4A2

500
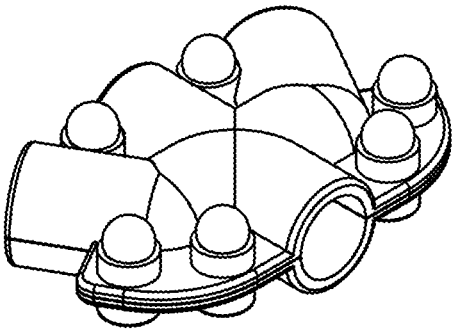
Fig. 5A
520
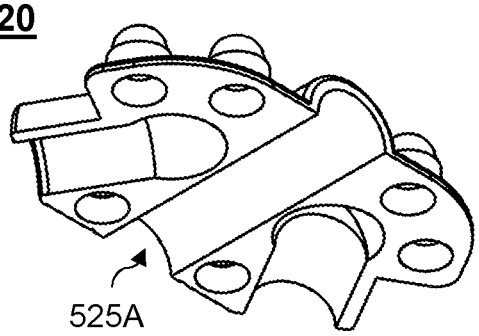
Fig. 5A1
540
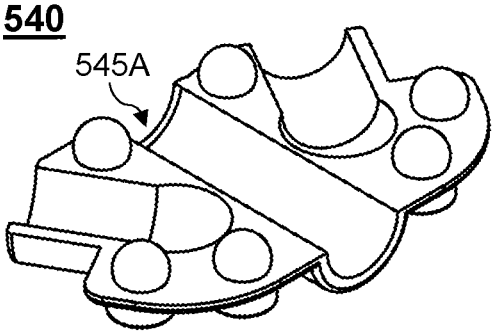
Fig. 5A2
600
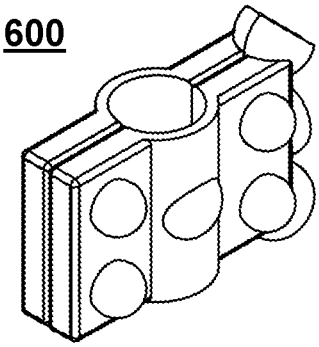
Fig. 6A
620
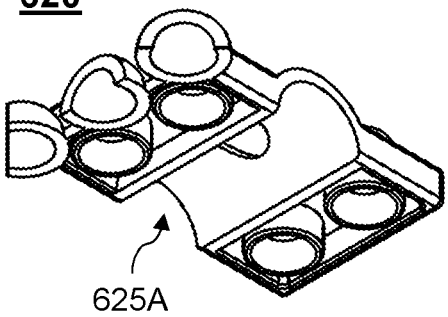
Fig. 6A1
640
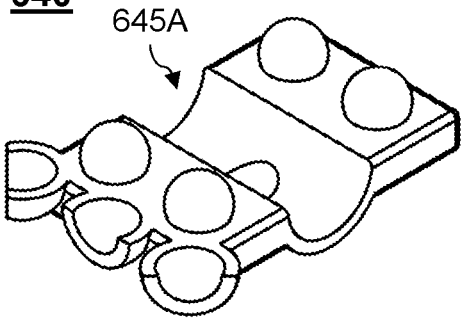
Fig. 6A2

Fig. 7A1

Fig. 7A2

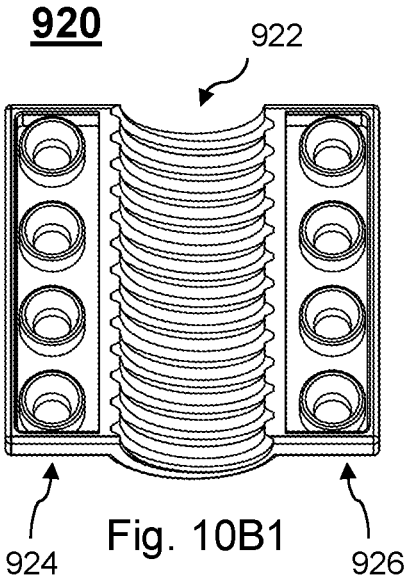
Fig. 10B1
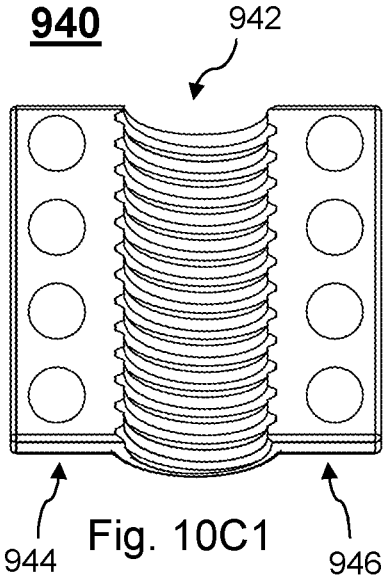
Fig. 10C1
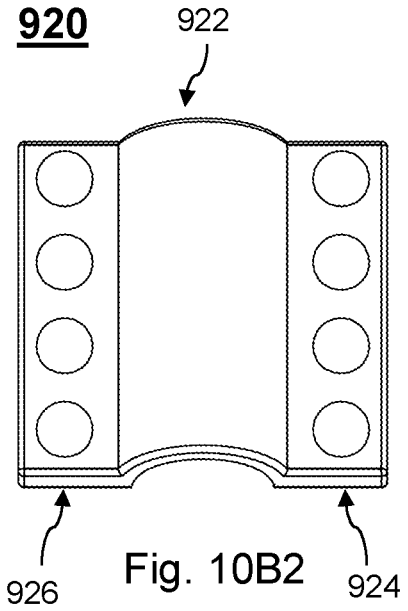
Fig. 10B2
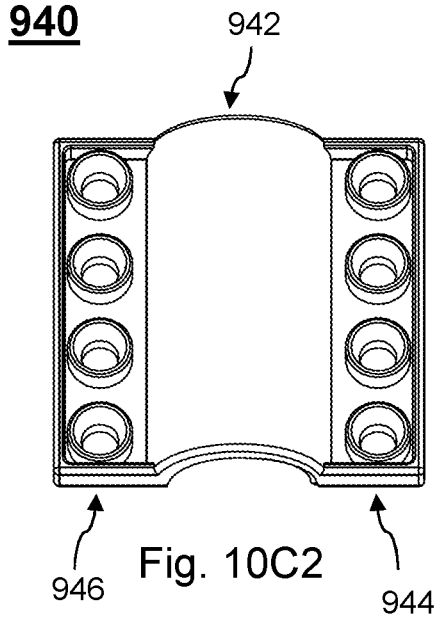
Fig. 10C2

BUILDING BLOCK AND BUILDING BLOCK ASSEMBLIES

FIELD

The present disclosure relates to building blocks and building block components, and more particularly to building blocks that are modular, inter-connectible, and/or stackable.

BACKGROUND

Modular and interconnectible building blocks for construction of toys, such as toy figures, toy vehicles, toy houses, toy farms, toy machines, toy models, and other toy assemblies, toy products and toy structures are known and have been recognised for their educational values, for example, in promoting and encouraging creativity, patience and perseverance. Modular and interconnectible toy building blocks are advantageous, for example, many different types of toy assemblies, toy products and toy structures can be built with a small number of well-designed building blocks of basic configurations and the building blocks can be re-used for building of other toy assemblies, toy products and toy structures. Modular and interconnectible building blocks are also used in building industries, for example, as modular components for construction of buildings and structures. Use of modular and interconnectible building blocks has been known to facilitate flexible, expeditious and standardised construction with less manual work requirements and promote productivity. In addition to application as toys and in the building industry, modular and interconnectible toy building blocks are also used for modular construction of tools, equipment, appliances, and many other types of products.

DISCLOSURE

Modular and inter-connectible building blocks and assemblies comprising modular and interconnectible are disclosed.

A building block assembly according to the disclosure comprises a first building block and a second building block, the first building block comprises a first main body including two lateral portions and a first bridging portion interconnecting the two lateral portions and a first connection means formed and distributed on the two lateral portions defining a first connection surface and a first connection direction. The second building block comprises a second main body including two lateral portions and a second bridging portion interconnecting the two lateral portions and a second connection means formed and distributed on the two lateral portions defining a second connection surface and a second connection direction. The first connection means and the second connection means are matched and compatible connection means in releasable mechanical snap engagement to form the assembly and the first bridging portion and the second bridging portion cooperate to define a building block receptacle having a receptacle wall and a receptacle axis. The building block receptacle is for receiving a third building block and comprises a retention means on the receptacle wall. The retention means is to resist sliding movement of the third building block relative to the building block receptacle in an axial direction defined by the receptacle axis of the building block receptacle.

In some embodiments, the receptacle is defined or extends between the two lateral portions of the first connection surface and between the two lateral portions of the second connection surface.

In some embodiments, the receptacle wall extends through the assembly in a direction parallel to the receptacle axis.

In some embodiments, the first bridging portion comprises an interior peripheral wall or a plurality of interior peripheral walls in addition to the first connection surface, and the second bridging portion comprises an interior peripheral wall or a plurality of interior peripheral walls in addition to the second connection surface. The first bridging portion and the second bridging portion are joined to cooperate to define the receptacle wall of the receptacle, the receptacle wall defining an outer boundary of the receptacle and being in abutment with an exterior peripheral wall or a plurality of exterior peripheral walls of the third building block. The first bridging portion and the second bridging portion are connected in series to form a closed bridging circuit.

In some embodiments, the main body and/or the bridging portion is plate-like and has a substantially uniform thickness.

In some embodiments, the lateral portions comprise a first wing member and a second wing member, the first wing member extends away from the bridging portion in a first lateral direction and the second wing member extends away from the bridging portion in a second lateral direction opposite to the first lateral direction, the lateral direction being orthogonal to the connection direction.

In some embodiments, a snap connection means is formed on a second connection surface of the first building block and or the second building block, the second connection surface being an opposite facing surface to the connection surface.

In some embodiments, the interior peripheral walls of the first main body and the second main body forming the receptacle which are in adjacency are in abutment contact.

In some embodiments, the receptacle has a receptacle bore which is defined by the receptacle wall, and the receptacle bore extends through the assembly or a substantial portion of the assembly in the axial direction of the receptacle axis.

In some embodiments, the receptacle wall extends through the assembly or a major portion of the assembly in the axial direction of the receptacle axis.

In some embodiments, the receptacle wall is to facilitate guided entry of the third building block into a least a minor portion of the receptacle along in the axial direction of the receptacle axis.

In some embodiments, the third building block is to protrude through one axial end or both axial ends of the assembly, the axial end being with respect to the receptacle axis.

In some embodiments, the receptacle wall is to provide guidance for the third building block to move into at least an axial portion of the receptacle in the axial direction of the receptacle axis until the third building block is stopped by the retention means or until a protruding connection means on the building block encounters the receptacle wall.

In some embodiments, the exterior peripheral wall or the plurality of exterior peripheral walls of the third building block defines an outer peripheral surface of the third building block, and a snap connection means is formed on the outer peripheral surface of the third building block. The retention means of the assembly and the snap connection means of the third building block are matched snap connection means which are to enter into snap engagement when the third building block is retained in the building block receptacle by the retention means.

In some embodiments, the retention means comprises protrusions and/or indentations which are formed on the receptacle wall. The protrusion projects from the receptacle wall and extends orthogonally towards the receptacle axis to protrudes into the receptacle. The indentation recesses into the receptacle wall in a direction orthogonal to the axial direction of the receptacle axis.

In some embodiments, the protrusions and/or indentations are distributed around the receptacle wall along or around a distribution plane which is orthogonal to the receptacle axis and/or along the axial direction of the receptacle axis.

In some embodiments, the retention means comprises helical threads formed on the receptacle wall with the receptacle axis as the thread axis so that a threaded third building block retained in the building block receptacle is prevented from axial sliding movement relative to the receptacle but can move in the axial direction upon rotation about the thread axis.

In some embodiments, the assembly is a building block clamp for detachable mounting or clamping onto the third building block.

A building block according to the disclosure comprises a main body, a first lateral portion, a second lateral portion and a bridging portion interconnecting the first and the second lateral portions. A connection means comprising a plurality of snap connectors is formed and distributed on the first and the second lateral portions to define a first connection surface and a first connection direction. The first lateral portion, the second lateral portion and the bridging portion cooperate to define a partial building block receptacle having a partial receptacle wall and a partial building block receptacle compartment. Retention means is formed on the partial receptacle wall. The partial building block receptacle is to cooperate with a corresponding partial building block receptacle of a corresponding building block to form a building block receptacle for receiving a third building block when the building block and the corresponding building block are mechanically connected to form a building block assembly. The retention means is to resist sliding movement of the third building block relative to the building block receptacle in an axial direction defined by the receptacle axis of the building block receptacle.

In some embodiments, the connection means comprises a plurality of snap connectors, the snap connectors comprising both male and female type snap connectors.

In some embodiments, male and female type connectors are distributed about a plane of symmetry a building block assembly can be formed by a pair of the building blocks with the corresponding connection surfaces in snap engagement.

A building block herein comprises one or a plurality of connectors to facilitate detachable or releasable mechanical connection between modular building blocks in abutment. The mechanical connection is typically by press-fitting or snap-fitting. The building block comprises one connector or a plurality of connectors on at least one connection surface and building blocks can be stacked with their respective connection surfaces in abutment connect and the connectors on their respective connection surfaces in detachable mechanical engagement.

A building block herein may be a toy building block. A toy building block is typically made of thermoplastics such as ABS (acrylonitrile butadiene styrene), PC (polycarbonate), or other plastic materials that a high degree of strength and rigidity, as well as a small degree of resilience to be slightly resiliently deformable to facilitate press-fit or snap-fit engagement.

A building block herein may be made of clay, ceramic, porcelain, concrete, or other mouldable materials that have a high rigidity and a very low degree of resilience or virtually no resilience.

A building block herein may also be made of wood, metals, for example, steel, aluminum, aluminum alloys, or other materials that can be shaped.

Where a building block is made of a material having a high rigidity with a very low degree of resilience or no resilience, the building block may connect with a building block having a sufficient degree of resilience to facilitate mechanical connection by resilient deformation of the connector(s) thereon.

In general, a building blocks can be rigid and slightly resilient or non-resilient, and the rigidity and resilience may be selected to suit applications by selecting appropriate materials or appropriate mix of materials.

A building block herein may be ceramic building block or a porcelain building block. The ceramic or porcelain building block may be in the form of a ceramic brick or a porcelain brick, a ceramic tile or a porcelain tile, a ceramic panel or a porcelain panel, or other forms of ceramic parts or porcelain parts without loss of generality. The ceramic or porcelain building blocks may be interconnected using binding agents such as glue, cement, or mortar to form the modules, assemblies or sub-assemblies, or interconnect with building blocks made of a rigid and slightly resilient material.

A building block herein typically comprises a main body, a first surface on a first side of the main body, a second surface on a second side of the main body, a peripheral portion extending between the first surface and the second surface, and a plurality of connectors formed on the main body. The main body is typically rigid or semi-rigid and the connectors have peripheral walls which are rigid or semi-rigid and having a small degree of resilience to facilitate snap engagement with corresponding connector through resilient deformation of the engagement portions of the connectors. The connectors are usually formed on a panel portion of the main body. In some embodiments, male connectors are formed on one panel portion and female connectors are formed on another panel portion separate from the panel portion on which the male connectors are formed. In some embodiments, male connectors and female connectors are formed on a common panel portion.

A connector herein means a building block connector unless the context requires otherwise. A building block connector comprises a connection portion having a coupling axis defining a coupling direction. The connection portion comprises an engagement portion for making closely fitted engagement with a matched connector portion of a matched connector to form a pair of engaged connectors.

An engagement portion comprises mechanical mating features for making closely fitted engagement with a corresponding engagement portion of a matched connector to form a pair of engaged engagement portions. An engagement portion may be a male engagement portion or a female engagement portion.

A connector is generally classified as a male connector or a female connector. However, a male connector may comprise a female engagement portion in addition to its inherent male engagement portion and a female connector may comprise a male engagement portion in addition to its inherent female engagement portion.

A male engagement portion comprises male mating features. A male engagement portion typically comprises a protrusion which is shaped and sized for closely-fitted reception of a corresponding female engagement portion. A protrusion adapted for closely-fitted reception of a corresponding female engagement portion is a matched corresponding male engagement portion of that corresponding female engagement portion. A protrusion herein is also referred to as a "protrusion portion", a "protruding member", a "protrusion member", "protrusion body", and "protruding body" and the terms are interchangeably used herein unless the context requires otherwise.

A female engagement portion comprises female mating features. A female engagement portion typically comprises a coupling receptacle which is shaped and sized for closely-fitted reception of a corresponding male engagement portion. A coupling receptacle adapted for closely-fitted reception of a corresponding male engagement portion is a matched corresponding female engagement portion of that corresponding male engagement portion. A receptacle herein means a coupling receptacle of a female building block connector unless the context requires otherwise. A coupling receptacle of a female building block connector is also referred to as a male engagement portion receptacle or a male-connector receptacle.

A pair of connectors having matched corresponding engagement portions when on separate building blocks are detachably engageable to form a releasable mechanical connection. When the pair of connectors have matched snap engagement portions, the connectors are snap engageable to form a snap engaged connector pair.

A male engagement portion and a corresponding female engagement portion having matched and compatible mating features will enter into closely fitted engagement when they are brought or moved relatively towards each other with their respective coupling axes aligned and press connected along the aligned coupling axes. The fitted or closely fitted engagement herein may be by interference fit or snap fit. When a pair of matched connectors herein are brought or moved relatively towards each other with their respective coupling axes aligned and then pressed together, the matched connectors will engage and enter into closely fitted engagement.

A connector has a characteristic radial profile. The radial profile of a connector is characterized by the radial extent of the engagement portion or the engagement portions of the connector between its axial ends. A snap connector is characterized by a non-uniform radial extent in the axial direction, and more particularly by a bulged radial profile.

A male connection portion comprises a protruding portion which is to enter into a receptacle of a corresponding female connection portion to make releasable mechanical engagement therewith. The protrusion portion may be in the form of a protrusion body, a protruding body, a protrusion member or a protruding member.

The protrusion portion of a male connection portion projects from a base surface and extends in an axial direction away from the base surface, the axial direction being with respect to the coupling axis of the protrusion portion. A male connection portion comprises a connector head defining its axial end. The axial extent of a protrusion portion, measured along the coupling axis of the male connection portion between the base surface from which it projects and its axial end, defines the height of the protrusion. The protruding body has an outer peripheral wall which defines the mating features of the protrusion portion, including shape, configuration, radial profile and dimensions.

The protrusion portion of a male snap connector has a radial profile which is defined by its outer peripheral wall. The radial profile of a snap connector is characterized by a non-uniform radial extent in the axial direction. A male snap connector typically comprises a bulged portion having a bulged radial profile and a reduced portion having a reduced radial profile.

A typical protrusion portion herein is an annular protrusion comprising a first protrusion portion and a second protrusion portion. The first protrusion portion and the second protrusion portion are in series and are aligned on the coupling axis. The first protrusion portion is in abutment with the base surface and the second protrusion portion comprises the axial end, which is usually a free axial end. The first protrusion portion is, in the axial direction, or axially, intermediate the second protrusion portion and the base surface.

The first protrusion portion is referred to as a neck portion which is supported on the base surface and the second protrusion portion is referred to as a head portion which is supported by the neck portion.

The head portion has an enlarged radial profile compared to the neck portion radial profile, and is also referred to as an enlarged portion. As the profile enlargement is in the radial direction, the head portion is also referred to as a widened portion.

In general, the head portion is an enlarged portion having a head portion radial profile which is a bulged radial profile, or a bulged profile in short.

The head portion has an outer periphery which is in the general form of a peripherally extending rib. A peripherally extending rib herein is an annular rib having the radial profile of the head portion radial profile in the peripheral direction. The annular rib is defined by the outer peripheral wall of the protrusion portion and may be continuous or non-continuous. The peripheral direction is orthogonal to the coupling axis and is a tangential direction to a circle defining the annular rib. The annular rib surrounds a core portion of the head portion, and the core portion of the head portion may be solid or hollow. When the core portion is hollow, the head portion is in the form of a hollow shell having an internal compartment. The head portion radial profile and the annular rib has the radial profile of a radial protrusion and defines an engagement portion, and more specifically, defines a male snap engagement portion of a male connection portion. The engagement portion on the head portion of a male connection portion is referred to as a first engagement portion or a first snap engagement portion of the protrusion portion or of the male connection portion for ease of reference. The terms "rib" and "ridge" are equivalent and are used interchangeably herein.

The bulged head portion has a maximum radial extent defining a maximum radial plane at an axial level with respect to the base surface. The maximum radial plane is a maximum transversal plane, and the axial level of the maximum radial plane is a maximum radial extent level.

The bulged portion has a lower surface which extends between the maximum radial plane and the base surface. The lower surface is a tapered surface which oppositely faces the base surface. The radial extent of the lower surface of the bulged head portion at an axial level decreases as the axial level moves closer towards the base level of the base surface to define a lower tapered surface. Conversely, the radial extent of the lower surface of the bulged head portion at an axial level increases as the axial level of the lower surface away from the base surface increases. The radial extent of the lower surface of the bulged head portion reaches a local minimum at an axial level where it joins the neck portion.

The head portion tapers to narrow as it extends axially from the maximum radial extent plane towards the base surface. Conversely, the head portion flares to widen as it extends axially from the base surface towards the maximum radial extent plane.

The axial free end of the head portion may be flat or rounded. Where the axial free end is flat, the male connector has a flat head. Where the axial end is rounded, the male connector has a rounded head. The rounded head may be in the shape of a dome, a spherical cap, or a rounded boss or other suitable shapes.

The head portion radial profile extends in a peripheral direction to define an annular outer periphery of the head portion and the neck portion radial profile extends in a peripheral direction to define an annular outer periphery of the neck portion.

The neck portion has reduced radial profile compared to the head portion radial profile, and is also referred to as a reduced portion. As the profile reduction is in the radial direction, the neck portion is also referred to as a narrowed portion.

In general, the neck portion is a reduced enlarged portion having a neck portion radial profile which is a tapered radial profile, or a tapered profile in short.

The neck portion has an outer periphery which is in the form of a peripherally extending channel. The peripherally extending channel is an annular channel having the radial profile of the neck portion radial profile in the peripheral direction. The annular channel is defined by the outer peripheral wall of the protrusion portion and may be continuous or non-continuous. The peripheral direction is orthogonal to the coupling axis and is a tangential direction to a circle defining the annular channel. The annular channel, that is, the peripherally extending channel, surrounds a core portion of the neck portion, and the core portion of the neck portion may be solid or hollow. When the core portion is hollow, the neck portion is in the form of a hollow shell having an internal compartment. The neck portion radial profile and the annular channel has the radial profile of a radial indentation and defines an engagement portion, and more specifically, a female snap engagement portion on a male connection portion. The engagement portion on the neck portion of a male connection portion is referred to as a second engagement portion or a second snap engagement portion of the protrusion portion or of the male connection portion for ease of reference. This second engagement portion is a retention portion which is adapted to receive and retain a neck receptacle portion of a female connector. The terms "channel" and "groove" are equivalent and are used interchangeably herein.

The neck portion has a local maximum radial extent at an axial level where it joins or is in abutment with the head portion. The local maximum radial extent defines a local maximum radial plane, which is also a local maximum transversal plane.

The neck portion has an outer peripheral surface which extends between the local maximum radial plane and the base surface. The outer peripheral surface is a tapered surface which oppositely faces the base surface. The radial extent of the outer peripheral surface of the neck portion at an axial level decreases as the axial level moves closer towards the base level of the base surface to define a tapered outer peripheral surface. Conversely, the radial extent of the outer peripheral surface of the narrowed neck portion at an axial level increases as the axial level of the outer peripheral surface away from the base surface increases. The radial extent of the outer peripheral surface of the neck portion reaches a local minimum at an axial level where it joins the head portion. The outer peripheral surface is optionally a smooth continuation of the lower surface of the head portion. Where the lower surface of the head portion follows a curved profile to taper, the radial profile of the outer peripheral surface may follow a curved profile which is a curved continuation of the curved profile to taper. In some embodiments, the curved profile follows a radius of curvature equal to half the maximum radial extent.

Therefore, the neck portion tapers to narrow as it extends axially from the local maximum radial extent plane towards the base surface. Conversely, the neck portion flares to widen as it extends axially from the base surface towards the local maximum radial extent plane.

While the peripheral channel is primarily defined by the outer peripheral surface of the neck portion in cooperation with the base surface, the entire channel may be regarded as being defined by the lower axial end of the enlarged portion, the narrowed neck portion and the base surface in cooperation.

The channel may have a constant radial extent in the axial direction or may have a tapered radial profile such that the radial extent of the neck portion decreases as its axial level decreases towards the base surface.

The tapering may follow a curved profile, for example the profile of a convex curve, a straight slope or other desired profiles without loss of generality.

In general, the axial extent of a protrusion of a connection portion is a fraction of the maximum radial extent of the protrusion, and the fraction is optionally between 20% and 80%, for example, in percentage terms, at 20, 25, 30, 35, 40, 45, 50, 55, 60, 65, 70, 75, 80, or any range or ranges defined by a combination of any of the aforesaid values and/or ranges. Typically, the axial extent will be in the higher range of between 50% and 80% where the protrusion has a rounded end or partial spherical end and in the lower range of 15% and 60% where the protrusion has a flat head or flat axial end. For an annular protrusion, the maximum radial extent E is the diameter D of a circle, the circle defines a maximum radial extent plane and the aforesaid fraction is also in respect of the diameter.

The axial extent between the maximum radial extent level and the axial free end of the protrusion portion is a fraction of the maximum radial extent of the protrusion, and the fraction is optionally between 5% and 50% of the maximum radial extent, E, at the maximum radial extent level, for example, in percentage terms, at 5, 10, 15, 20, 25, 30, 35, 40, 45, 50, or a range or any ranges formed by a combination of any of the aforesaid values as limits of a range or limits of ranges. This axial extent of the upper portion of the protrusion will be in the lower range of between 5% and 30% where the protrusion has a flat head or flat axial end, and in the higher range of between 25% and 50% where the protrusion has a rounded end or partial spherical end. When the axial extent of the upper protrusion is 50%, the upper portion has a hemispherical shape.

The axial extent between the base surface and the maximum radial extent plane of the protrusion is a fraction of the maximum radial extent of the protrusion, and the fraction is optionally between 6% and 30% of the maximum radial extent, E, for example, in percentage terms, at 6, 8, 10, 12, 15, 18, 20, 25, 30, or a range or any ranges formed by a combination of any of the aforesaid values as limits of a range or limits of ranges.

The axial extent of the bulged portion is a fraction of the maximum radial extent of the protrusion, and the fraction is optionally between 5% and 25% of the maximum radial extent, E, for example, in percentage terms, at 5, 10, 15, 20, 25, or a range or any ranges formed by a combination of any of the aforesaid values as limits of a range or limits of ranges.

The axial extent of the neck portion is a fraction of the maximum radial extent of the protrusion, and the fraction is optionally between 5% and 15% of the maximum radial extent, E, for example, in percentage terms, at 5, 10, 15, or a range or any ranges formed by a combination of any of the aforesaid values as limits of a range or limits of ranges.

The radial extent of the neck portion is a fraction of the maximum radial extent of the protrusion, and the fraction is optionally between 90% and 99% of the maximum radial extent, for example, in percentage terms, at 90, 91, 92, 93, 94, 95, 96, 97, 98, 99, or a range or any ranges formed by a combination of any of the aforesaid values as limits of a range or limits of ranges.

The radial extent of the radial indentation defining the channel of the neck portion is a fraction of the maximum radial extent of the protrusion, and the fraction is optionally between 1% and 6%, for example, in percentage terms, at 1, 2, 3, 4, 5, 6 or more, or a range or any ranges formed by a combination of any of the aforesaid values as limits of a range or limits of ranges.

The protrusion portion or a portion thereof may be a convex annular portion which follows a convex curvature as it extends towards the base surface in the direction of the coupling axis. The convex annular portion may have the shape of a spherical segment having a radius of curvature R, where R is half the value of the maximum radial extent of the maximum radial plane, and an axial extent or height h. The maximum radial plane is usually contained between two smaller radial planes so that the radial extent of the convexly curved portion increases from a first radial extent defined by a first smaller radial plane to the maximum radial extent and then decreases to a second radial extent defined by a second smaller radial plane as the curved portion extends along the direction of the coupling axis, the radial plane extending in a transversal direction or a lateral direction which is orthogonal to the coupling axis.

The protrusion portion between the base surface and the maximum radial plane may be in the shape of a spherical segment or a truncated cone, i.e., frusto-cone. The axial height between the base surface and the maximum radial plane is optionally between 20% and 85% of R, where R is the radius of the sphere defining the spherical segment, for example, in percentage terms, at 20, 25, 30, 35, 40, 45, 50, 55, 60, 65, 70, 75, 80, 85, or a range or any ranges formed by a combination of any of the aforesaid values as limits of a range or limits of ranges.

Where the neck portion of the protrusion portion in abutment with the base surface is in the shape of a spherical segment, the neck portion has a shape of a lower spherical segment and has a convexly curved profile in the radial direction. When the neck portion is so shaped, the neck portion has a smaller radial extent at the base surface and a local maximum radial extent at an axial separation from the base surface.

The radial extent of the neck portion at the base surface is at a fraction of the maximum radial extent, and the fraction is optionally between 90% and 98.8%, for example, in percentage terms, at 90, 92, 94, 96, 98, 98.8, or a range or any ranges formed by a combination of any of the aforesaid values as limits of a range or limits of ranges.

The local maximum radial plane is elevated above the base surface and a radial plane having a smaller radial extent is in abutment with the base surface.

The neck portion may taper to join the base surface and joins at a joining angle. The tapering may follow a convexly curved profile, may have a constant slope, or other desired tapering manner. The joining angle is an acute angle which is optionally between 50 degrees and 88 degrees, for example, in degree terms, 50, 55, 60, 65, 70, 75, 70, 80, 85, 88, or a range or any ranges defined by a combination of any of the aforesaid values and/or ranges.

The protrusion portion, for example, the bulged portion or the reduced portion, may comprise a cylindrical body or a prismatic body which projects away from the base surface, with a tapered portion formed at a peripheral region in abutment with or in proximity to the base surface.

A snap connector or the engagement portion of a snap connector herein is axis-symmetrical. An axis symmetrical engagement portion has axis-symmetrical mating feature profiles. An axis-symmetrical engagement portion or connector typically has a circular cross section at an axial defined by the coupling axis of the engagement portion or the connector. In some embodiments, the engagement portion may not be exactly axis-symmetrical but has a square cross-section or a cross-section of a regular polygon having five side, six sides, seven sides, eight side, nine sides, ten side or more. A snap connector herein includes both the axis-symmetrical and non-axis-symmetrical types unless the context requires otherwise.

On the other hand, the radial extent of a protrusion portion of a press-fit or interference-f it connector without snap-fit features is substantially uniform in the axial direction.

A female connection portion comprises a coupling receptacle for reception of a protrusion portion of a corresponding male connector. More specifically, a female connection portion comprises a coupling receptacle, or receptacle in short, for closely-fitted reception of a protrusion portion of a corresponding male connection portion to facilitate snap engagement. When a male engagement portion is in closely fitted engagement with a female engagement portion, the male engagement portion is received by the receptacle and at least a portion of the male engagement portion projects into and is received inside the receptacle compartment.

The receptacle of a female connector comprises a receptacle compartment and a receptacle entry through which an axial end of a protrusion of a corresponding male connection portion is to enter the receptacle compartment. The receptacle comprises an inner peripheral wall which defines the receptacle compartment, the receptacle entry, as well as a receptacle entry plane and an entry aperture at the receptacle entry. The entry aperture is typically on an axial end of the receptacle and is also referred to as an access aperture and the receptacle entry plane is orthogonal to the coupling axis. The entry aperture defines a minimum radial clearance of the receptacle which in turn defines a maximum radial extent of the protrusion or the bulged portion of a protrusion that can enter into the receptacle without radial deformation of the receptacle entry or the male connector protrusion. The coupling receptacle extends in the axial direction away from the receptacle entry to define an axial extent of the receptacle compartment. The axial extent of a receptacle, as measured along the coupling axis of the receptacle between the axial ends of the inner peripheral wall which defines the receptacle compartment, defines the height of the receptacle. The inner peripheral wall of the receptacle defines the shape, configuration, dimensions of the receptacle compartment. The receptacle may be in the form of a receptacle portion, a receptacle body, or a receptacle member. In some embodiments, a female connector comprises a peripheral wall which defines the receptacle. The peripheral wall may comprise an inner peripheral wall which defines the receptacle compartment and the receptacle compartment radial profile and an outer peripheral wall which surrounds the inner peripheral wall and defines the outer periphery of the receptacle. The peripheral wall may be a continuous wall or a non-continuous wall. In some embodiments, the outer peripheral wall of the receptacle depends from the panel portion and has a substantial portion of its axial extent which is spaced apart from or independent of the panel portion. For example, the outer peripheral wall may have, in percentage terms of its axial extent or of the maximum radial extent of the receptacle compartment, 55, 60, 65, 70, 75, 80, 90, 95, 100, or a range or any ranges defined by a combination of any of the aforesaid values and/or ranges which is laterally separated from the panel portion so that there is radial spatial separation between the outer peripheral wall and the panel portion from which the receptacle depends. In some embodiments, a minor portion of the axial extent of the receptacle is spaced apart from or independent of the panel portion, and the minor portion, in percentage terms of its axial extent or of the maximum radial extent of the receptacle compartment, is 5, 6, 7, 8, 9, 9, 10, or a range or any ranges defined by a combination of any of the aforesaid values and/or ranges.

A female snap connector comprises a snap-fit receptacle which is shaped and dimensioned for closely fitted engagement of a male snap engagement portion. When a female snap connector and a male snap connector are in closely-fitted snap engagement, the male engagement portion is subject to a small radially inward compression force exerted radially inwardly by the receptacle functioning as a female engagement portion, and the receptacle is subject to a small radial outward expansion force which is exerted radially outwardly by the male engagement portion.

The receptacle compartment of a female connector has a radial profile which is defined by the inner peripheral wall of the receptacle. The radial profile of the receptacle compartment of a female snap connector is characterized by a non-uniform radial extent in the axial direction, and typically includes a bulged radial profile of a bulged receptacle portion and a reduced radial profile of a reduced receptacle portion in the axial direction. The terms receptacle, coupling receptacle, snap-fit receptacle, receptacle portion, receptacle body, and receptacle member are interchangeably used herein unless the context requires otherwise.

The entry aperture is on or at one axial end of the receptacle and is an annular aperture which provides access for a male engagement portion so that a male engagement portion can enter into the receptacle compartment through that axial end and through the entry aperture and then enter into closely-fitted engagement with the receptacle. A receptacle may have an entry aperture on each of the two axial ends of the receptacle to facilitate entry or exit of a protrusion portion of a male connector from a selected one of the two axial ends.

The entry aperture has or may have a radial clearance which is smaller or slightly smaller than the maximum radial extent of a male engagement portion, and the maximum radial extent of a male engagement portion is typically located on the bulged portion of the male connector protrusion. A smaller radial clearance at the entry aperture than the maximum radial extent of the bulged portion usually means a radial constriction at the axial end of the receptacle. The bulged portion of a male connection means would need to overcome the radial constriction in order to enter the receptacle compartment from outside the receptacle compartment or to leave the receptacle if already inside the receptacle compartment. A minimum radial clearance extent of the receptacle is defined at the entry aperture.

A receptacle may comprise a first receptacle portion having a first receptacle compartment and a second receptacle portion having a second receptacle compartment. The first receptacle portion and the second receptacle portion are in series and are aligned on the coupling axis. The first receptacle portion has an axial end comprising the receptacle entry and the second receptacle portion extends axially away from the first receptacle portion and the receptacle entry. The first receptacle portion is to surround and snap on the neck portion of a corresponding male engagement portion upon snap engagement therewith and is referred to as a neck receptacle portion. The neck receptacle portion is also referred to as a neck portion engagement portion and comprises a neck receptacle compartment. The second receptacle portion is to surround and snap on the head portion of a corresponding male engagement portion upon snap engagement therewith and is referred to as a head receptacle portion. The head receptacle portion is also referred to as a head portion engagement portion and comprises a head receptacle compartment. The two receptacle portions, namely, the head receptacle portion and the neck receptacle portion, may be separate or integrally formed.

The engagement portion of a receptacle portion is an annular receptacle portion defined by a portion of the inner peripheral wall of the receptacle defining the receptacle portion. The engagement portion may be in the embodiments of an annular bracket portion, an annular bracket member, an annular collar portion, or an annular collar member. In some embodiments, a receptacle portion has an access aperture at each of its axial ends to facilitate entry and/or exit of a matched male engagement portion at either axial end.

In some embodiments, the receptacle may have only one receptacle portion, for example, only the head receptacle portion or only the neck receptacle portion.

The head receptacle portion comprises a head receptacle compartment which is adapted for making snap engagement with the head portion of a corresponding male connector, and has a radial clamping profile which is complementarily shaped and sized to match the radial profile of the bulged portion of the corresponding male connector.

The head receptacle portion is an enlarged receptacle portion, also referred to as a widened receptacle portion, or an enlarged portion in short. The head receptacle portion has a head receptacle portion radial profile which is an enlarged radial profile compared to the neck receptacle portion radial profile. The head receptacle portion radial profile extends in a peripheral direction to define an annular inner periphery of the head receptacle portion. The head receptacle portion radial profile and the inner periphery of the head receptacle portion is defined by a portion of the inner peripheral wall of the receptacle defining the head receptacle portion. The engagement portion of a head receptacle portion is typically in the form of an annular clamp or clip, and in example embodiments in the form of an annular bracket portion, an annular bracket member, an annular collar portion, or an annular collar member. The maximum radial clearance extent of the receptacle is usually defined in the head receptacle portion.

The portion of the inner peripheral wall of the receptacle defining the head receptacle portion and the head receptacle compartment has a radial profile of an indentation or a recess, with the indentation or access inwardly facing the coupling axis. The indentation has a radial profile which defines the head receptacle portion radial profile. The radial profile may be angled or curved and extends peripherally in a peripheral direction, that is annularly, to define the head receptacle compartment and its boundary. The peripheral direction is orthogonal to the coupling axis and is a tangential direction to a circle defining the annular clamp or clip. The annular clamp or clip is in the form of an annular channel which surrounds a core portion of the head receptacle portion. The head receptacle portion defines a female snap engagement portion of the female connection portion, and is referred to as a first engagement portion or a first snap engagement portion of the receptacle, or of the female connection portion, for ease of reference. The terms "channel" and "groove" are used interchangeably herein.

The head receptacle compartment has a maximum radial extent defining a maximum radial clearance and a maximum radial plane at an axial level referred to a maximum radial extent level. The maximum radial plane is also a maximum transversal plane. The radial extent of the head receptacle portion decreases as the axial distance from the maximum radial extent level increases. Specifically, the radial extent of the head receptacle portion decreases as the head receptacle portion extends away from the maximum radial extent level and towards the receptacle entry, and the radial extent of the head receptacle portion decreases as the head receptacle portion extends away from the maximum radial extent level and away from the receptacle entry. Therefore, the head receptacle portion tapers to narrow as its axial distance away from the maximum radial extent plane or the maximum radial extent level increases. Conversely, the head receptacle portion flares to widen as it extends axially towards the maximum radial extent plane or the maximum radial extent level.

The axial end of the head receptacle portion distal to the receptacle entry may be flat or curved, for example, may have the shape of a spherical cap or other desired shapes.

The neck receptacle portion comprises a neck receptacle compartment which is adapted for making snap engagement with the neck portion of a corresponding male connector and has a radial clamping profile which is complementarily shaped to match the radial profile of the neck portion of the corresponding male connector.

The neck receptacle portion is a reduced receptacle portion compared to the head receptacle portion radial profile. The neck receptacle portion is a reduced receptacle portion, since it has a neck receptacle portion radial profile which is smaller than the radial profile of the head receptacle portion radial profile. The reduced receptacle portion is also referred to as a narrowed receptacle portion, or a reduced portion in short. The neck receptacle portion radial profile is defined by a portion of the inner peripheral wall of the receptacle which defines the neck receptacle portion and the inner periphery of the neck receptacle portion. The neck receptacle portion radial profile extends in a peripheral direction to define an annular inner periphery of the neck receptacle portion. The portion of the inner peripheral wall of the receptacle which defines the neck receptacle portion and the neck receptacle compartment has a radial profile of an indentation or a recess, and the indentation or access is inwardly facing the coupling axis and the centre of the maximum radial plane of the head receptacle portion. The indentation has a radial profile which is or which defines the neck receptacle portion radial profile. The radial profile may be angled or curved and extends peripherally in a peripheral direction, that is annularly, to define a neck receptacle compartment and its boundary.

The engagement portion of an example neck receptacle portion is in the form of an annular clamp or an annular clip which surrounds and defines the neck receptacle portion. The annular clamp or clip may have a radial profile of a clamping bracket or a clamping collar. The neck receptacle portion in exemplary embodiments is in the form of an annular bracket portion, an annular bracket member, an annular collar portion, or an annular collar member. The terms "bracket" and "collar" are interchangeably used herein and shall bear the same meaning unless the context requires otherwise. A clamping bracket herein is an inclined bracket having a recess or indentation facing the coupling axis and the centre of the maximum radial plane of the head receptacle portion. The bracket extends peripherally in a peripheral direction to define a neck receptacle compartment portion and its boundary. The peripheral direction is orthogonal to the coupling axis and is a tangential direction to a circle defining the annular clamp or clip. The neck receptacle portion defines a female snap engagement portion of the female connection portion, and is referred to as a second engagement portion or a second snap engagement portion of the receptacle, or of the female connection portion, for ease of reference. This second engagement means, similar to the first engagement means, is a retention portion defining a female retention means. The minimum radial clearance extent of the receptacle is usually defined in the neck receptacle portion.

The reduced receptacle portion has a local maximum radial extent defining a local maximum radial plane at an axial level referred to a local maximum radial extent level. The local maximum radial plane is also a local maximum transversal plane. The radial extent of the neck receptacle compartment decreases as the axial distance away from the local maximum radial extent level towards the receptacle entry increases. Specifically, the radial extent of the neck receptacle compartment decreases as the neck receptacle compartment extends away from the local maximum radial extent level and towards and joins the receptacle entry. The neck receptacle compartment is a tapered receptacle portion which tapers to narrow as it extends axially towards the receptacle entry. Conversely, the neck receptacle compartment flares to widen as it projects axially away from the receptacle entry.

The tapered entry end of the neck receptacle portion is optionally shaped and sized to operate as an engagement portion, or more specifically a male engagement portion, for engaging with or snap on the narrowed neck portion of the corresponding male connection portion, for example, by wedged engagement. Therefore, this tapered entry end be regarded as a third snap engagement portion of the receptacle.

The tapering may follow a curve, for example, a concave curve, a straight slope or other desired profiles without loss of generality.

The receptacle of a female connection portion is adapted to accommodate the protrusion of a male connection portion such that when two building blocks having matched connection means are stacked and their matched corresponding connection means in releasable engagement, the corresponding connection surfaces of the building blocks are in flush abutment and even contact. To meet the accommodation requirements, the axial end or ceiling of the receptacle compartment which is distal to the entry end would need to be at an axial level sufficient to accommodate the protrusion.

Where the entry end of the receptacle is at the axial level of the connection surface, as is usually the case, the ceiling end of the receptacle would be at an axial level corresponding to the axial extent of the protrusion from the connection surface, unless the ceiling end is an open end that allows the protrusion to pass through. In general, the axial extent of the receptacle compartment is a fraction of the maximum radial extent, E, of the protrusion or of the receptacle, and the fraction is optionally between 15% and 80%, for example, in percentage terms, at 15, 20, 25, 30, 35, 40, 45, 50, 55, 60, 65, 70, 75, 80, or a range or any ranges defined by a combination of any of the aforesaid values and/or ranges. Typically, the axial extent will be in the higher range of between 50% and 80% where the protrusion has a rounded end or partial spherical end and in the lower range of 15% and 60% where the protrusion has a flat head or flat axial end.

A head receptacle portion which is adapted to snap on the bulged portion has a radial clamping profile which is complementarily shaped to match the radial profile of the bulged of the head portion.

In order to provide sufficiently effective snap griping on the bulged portion, the axial extent of the radial clamping profile of the head receptacle portion, which is determined by the radial profile of the annular bracket, would be comparable to the axial extent of the bulged portion of the corresponding male engagement portion. In general, the axial extent of the head receptacle portion would be a fraction of the maximum radial extent of the bulged portion, and the fraction would optionally be between 10% and 40%, for example, in percentage terms, at 10, 12, 14, 16, 18, 20, 22, 24, 26, 28, 30, 32, 34, 36, 38, 40, or a range or any ranges formed by a combination of any of the aforesaid values as limits of a range or limits of ranges.

The head receptacle portion is optionally symmetrical about a radial plane of symmetry, which corresponds to the maximum radial extent plane of the bulged receptacle portion or the bulged portion of the protrusion on snap engagement. The plane of symmetry divides the head receptacle portion into symmetrical halves about the radial plane of symmetry. The head receptacle portion tapers to narrow as it extends axially away from the maximum radial extent plane to taper. The head receptacle portion optionally follows a concave profile or has a concave radial profile as it extends axially to taper. Optionally, the concave profile follows or matches the convex profile of the corresponding bulged portion. In some embodiments, the concave profile follows a concave curvature having a diameter equal to or comparable to the maximum radial extent of the bulged portion. The tapering may follow a straight slope or other desired profiles without loss of generality. The concave curve may have a radius of curvature comparable to half the maximum radial extent E.

The radial extent of the head receptacle portion at an axial end of the head receptacle portion where symmetry about the plane of symmetry ends is a fraction of the maximum radial extent of the bulged receptacle portion, and the fraction would optionally be between 95% and 99%, for example, in percentage terms, at 95, 96, 97, 98, 99, or a range or any ranges formed by a combination of any of the aforesaid values as limits of a range or limits of ranges.

The neck receptacle portion has an axial extent to provide snap grip on the neck portion of the male connector. The axial extent is a fraction of the maximum radial extent of the bulged portion which, in percentage terms, is optionally between 2 and 10, for example, at 2, 3, 4, 5, 6, 7, 8, 9, 10, or a range or any ranges defined by a combination of any of the aforesaid values and/or ranges.

In order to provide sufficient or effective snap clamping on the neck portion of the protrusion, the axial extent of the radial clamping profile of the neck receptacle portion, which is the radial profile of the annular bracket, would be comparable to the axial extent of the neck portion of the corresponding male engagement portion. In general, the axial extent of the neck receptacle portion would be a fraction of the radial extent of the neck portion at the base surface, and the fraction would optionally be between 10% and 35%, for example, in percentage terms, at 10, 12, 14, 16, 18, 20, 22, 24, 26, 28, 30, 32, 35, or a range or any ranges formed by a combination of any of the aforesaid values as limits of a range or limits of ranges.

The axial extent of the neck receptacle portion can be expressed as a fraction of the maximum radial extent of the receptacle, and the fraction would optionally be between 1.9% and 5%, for example, in percentage terms, at 1.9, 2, 2.0, 2.5, 3, 3.5, 4, 4.0, 4.5, 5, or a range or any ranges formed by a combination of any of the aforesaid values as limits of a range or limits of ranges.

The neck receptacle portion tapers to narrow as it extends axially towards the access aperture to define a narrowed access aperture to facilitate snap fit.

As a result of the tapering, the access aperture at the tapered axial end of the neck receptacle portion has a radial extent which is a fraction of the maximum radial extent of clearance of the internal compartment of the receptacle, and the fraction is optionally between 85% and 96%, for example, in percentage terms, at 85, 90, 95, 96, or a range or any ranges formed by a combination of any of the aforesaid values as limits of a range or limits of ranges.

As a result of the tapering, the inner peripheral wall of the neck receptacle portion is at an inclination angle to a radial plane at the access aperture axial end of the neck receptacle portion. The inclination angle is optionally between 50 degrees and 88 degrees, for example, in degree terms, 50, 55, 60, 65, 70, 75, 70, 80, 85, 88, or any range or ranges defined by a combination of any of the aforesaid values and/or ranges. Preferably, the inclination angle corresponds to the joining angle to facilitate closely fitted engagement between the neck receptacle portion and the neck portion.

Where the receptacle comprises both the neck receptacle portion and the head receptacle portion, both the neck receptacle portion and the head receptacle portion may be defined by an integrally formed peripheral wall of the receptacle, and the axial extent of the peripheral wall of the receptacle would optionally be between 30% and 85% of R, for example, in percentage terms, at 30, 35, 40, 45, 50, 55, 60, 65, 70, 75, 80, 85, or a range or any ranges defined by a combination of any of the aforesaid values and/or ranges.

FIGURES

Figure 8:
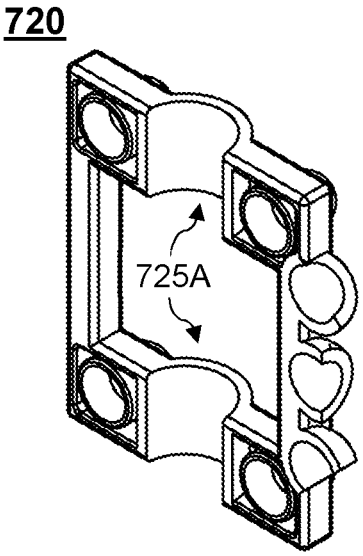
Figure 8:
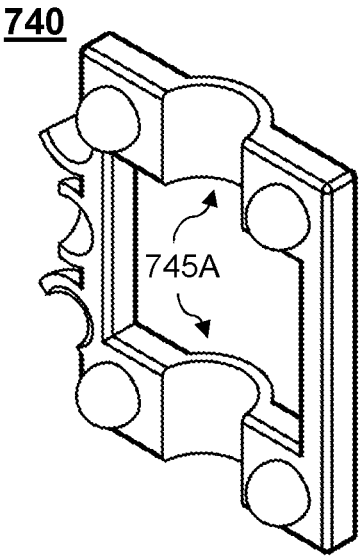
Figure 8:
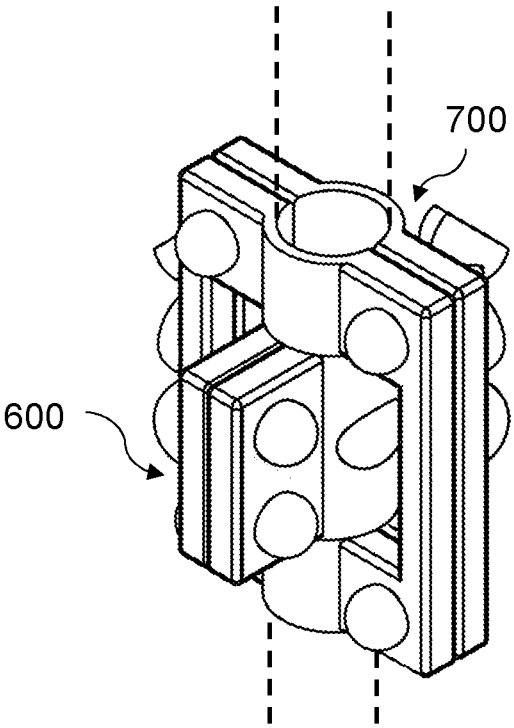
Figure 9:
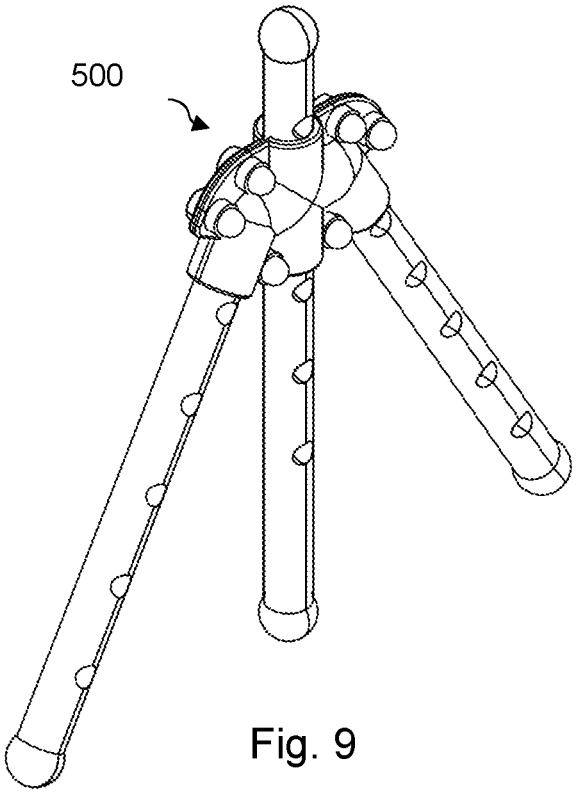
Figure 10:
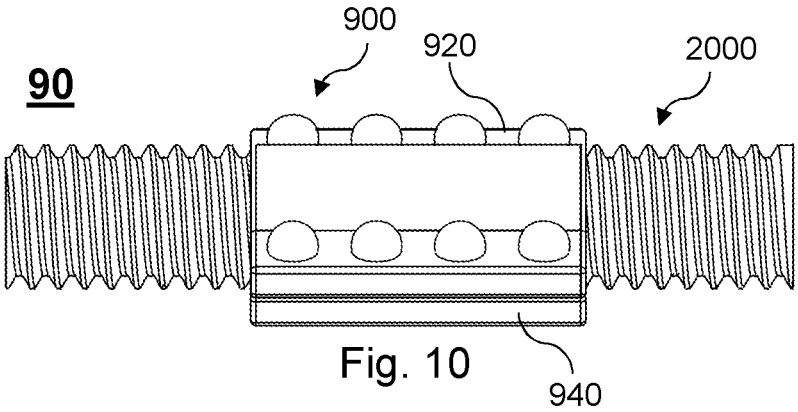
Figure 10A:
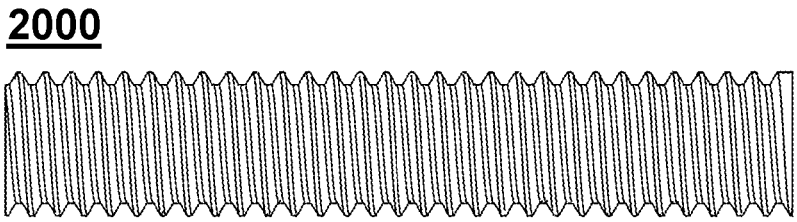

Embodiments of the present disclosure are described herein by way of example and with reference to the accompanying Figures, in which:

FIG. 1 is a perspective view of a building block assembly comprising an example building block mount and a building block stack according to the present disclosure, FIGS. 1A and 1A1 are respectively perspective and plan views of the building block mount of FIG. 1, FIG. 1A2 is an exploded view of the building block mount of FIG. 1, FIG. 1B is a perspective view of another building block assembly comprising an example building block mount and a building block stack according to the present disclosure, FIGS. 1B1 and 1B2 are respectively perspective and exploded views of the building block mount of FIG. 1B, FIGS. 1C and 1C1 are respectively perspective and explode views of the building block stack of FIG. 1, FIG. 1D is a perspective view of another building block assembly comprising an example building block mount and an example building block stack, FIG. 1D1 is a perspective view of the example building block stack of FIG. 1D, FIG. 2A is a perspective view of an example building block mount according to the present disclosure, FIGS. 2A1 and 2A2 are respectively perspective and exploded views of the building block mount of FIG. 2A, FIG. 3A is a perspective view of an example building block mount according to the present disclosure, FIGS. 3A1 and 3A2 are respectively perspective and exploded views of the building block mount of FIG. 3A, FIG. 4A is a perspective view of an example building block mount according to the present disclosure, FIGS. 4A1 and 4A2 are perspective views of the first and second mount parts of the building block mount of FIG. 4A, FIG. 5A is a perspective view of an example building block mount according to the present disclosure, FIGS. 5A1 and 5A2 are perspective views of the first and second mount parts of the building block mount of FIG. 5A, FIG. 6A is a perspective view of an example building block mount according to the present disclosure, FIGS. 6A1 and 6A2 are perspective view of the first and second mount parts of the building block mount of FIG. 6A, FIG. 7A is a perspective view of an example building block mount according to the present disclosure, FIGS. 7A1 and 7A2 are perspective view of the first and second mount parts of the building block mount of FIG. 7A, FIG. 8 is a perspective view of a sub-assembly building block mounts, FIG. 9 is an example building block structure constructed from building blocks and building block mounts according to the disclosure, FIG. 10 shows another example building block assembly, and FIGS. 10A, 10B1, 10B2, 10C1 and 10C2 show the various components of the building block assembly of FIG. 10.

DESCRIPTION

An example structure 10 comprises an example building block assembly 100 detachably mounted on an example building block 1000, as depicted in FIG. 1. The building block assembly 100 comprises a first building block 120 and a second building block 140 in releasable engagement. The example building block 1000 is a building block ensemble comprises a first building block 1000A and a second building block 1000B which are stacked and interconnected, as depicted in FIGS. 1C and 1C1.

The building block assembly 100 is to operate as a building block mount in this example and will be so referenced where appropriate. The first building block 120 is an example of a first mount member of the building block mount and will share the same reference numeral as the first building block, and the second building block 140 is an example of a second mount member of the building block mount and will share the same numeral with the second building block for ease of reference. Likewise, the building block assembly 100 and the building block mount will share the same reference numeral for ease of reference.

The first building block 120 comprises a main body which comprises a bridging portion 122, a first lateral portion 124 and a second lateral portion 126. The bridging portion 122 is intermediate the first lateral portion 124 and the second lateral portion 126 and interconnects the first lateral portion 124 and the second lateral portion 126. The bridging portion 122 comprises a first peripheral wall which is shaped to define a partial receptacle and a partial receptacle compartment of the partial receptacle. The first peripheral wall 125 includes an inner peripheral surface 125A which faces the partial receptacle compartment and an outer peripheral surface 125B which faces away from the partial receptacle compartment. The first peripheral wall 125 comprises an intermediate wall portion 125*i* which is intermediate a first lateral wall portion 125*j* and a second lateral wall portion 125*k*. Each of the first lateral wall portion and the second lateral wall portion is orthogonal to the intermediate wall portion 125*i* in this example. The first peripheral wall 125 has an internal surface 125A which faces towards the partial receptacle compartment and an external surface 125B which faces away from the partial receptacle compartment.

The first lateral portion 124 comprises a first lateral member which extends away from the bridging portion and from the partial receptacle compartment. The example first lateral member is in the form of a panel member and includes a first major surface and a second major surface which is opposite facing to the first major surface. A plurality of snap connectors is formed on the first major surface to define a first connection surface and a first connection direction. The first connection surface is for entering into snap engagement with a corresponding connection surface of the second mount member 140. A plurality of snap connectors is optionally formed on the second major surface to define a second connection surface and a second connection direction opposite to the first connection surface.

The second lateral portion 126 comprises a second lateral member which extends away from the bridging portion and from the partial receptacle compartment. The direction of extension of the second lateral portion 126 is opposite to that of the first lateral portion 124. The example second lateral member is also in the form of a panel member and includes a first major surface and a second major surface which is opposite facing to the first major surface. A plurality of snap connectors is formed on the first major surface to define a first connection surface and a first connection direction. The first connection surface is for entering into snap engagement with a corresponding connection surface of the second mount member 140. A plurality of snap connectors is optionally formed on the second major surface to define a second connection surface and a second connection direction opposite to the first connection surface.

The first connection surfaces of the first and second lateral portions 124, 126 collectively define a connection surface of the first mount member 120. The snap connectors on the first connection surfaces of the first and second lateral portions 124, 126 collectively define a connection means of the first mount member 120. The connection means on the first connection surfaces of the first and second lateral portions 124, 126 comprises snap connectors of the same mating type, which in this example is of the female type. In some embodiments, the connection means on the first connection surfaces of the first and second lateral portions 124, 126 comprises snap connectors of different or opposite mating types. A mating type herein can be a male mating type or a female mating type.

The second building block 140 comprises a main body which comprises a bridging portion 142, a first lateral portion 144 and a second lateral portion 146. The bridging portion 142 is intermediate the first lateral portion 144 and the second lateral portion 146 and interconnects the first lateral portion 144 and the second lateral portion 146. The bridging portion 142 comprises a second peripheral wall 145 which is shaped to define a partial receptacle compartment. The second peripheral wall 145 includes an inner peripheral surface 145A which faces the partial receptacle compartment and an outer peripheral surface 145B which faces away from the partial receptacle compartment. The second peripheral wall 145 comprises an intermediate wall portion 145*i* which is intermediate a first lateral wall portion 145*j* and a second lateral wall portion 145*k*. Each of the first lateral wall portion 145*j* and the second lateral wall portion 145*k* is orthogonal to the intermediate wall portion 145*i*. The first peripheral wall 145 has an internal surface 145A which faces towards the partial receptacle compartment and an external surface 145B which faces away from the partial receptacle compartment, as depicted in FIG. 1A1.

The first lateral portion 144 comprises a first lateral member which extends away from the bridging portion and from the partial receptacle compartment. The example first lateral member is in the form of a panel member and includes a first major surface and a second major surface which is opposite facing to the first major surface. A plurality of snap connectors is formed on the first major surface to define a first connection surface and a first connection direction. The first connection surface is for entering into snap engagement with a corresponding connection surface of the first mount member 120. A plurality of snap connectors is optionally formed on the second major surface to define a second connection surface and a second connection direction opposite to the first connection surface.

The second lateral portion 146 comprises a second lateral member which extends away from the bridging portion and from the partial receptacle compartment. The direction of extension of the second lateral portion 146 is opposite to that of the first lateral portion 144. The example second lateral member is also in the form of a panel member and includes a first major surface and a second major surface which is opposite facing to the first major surface. A plurality of snap connectors is formed on the first major surface to define a first connection surface and a first connection direction. The first connection surface is for entering into snap engagement with a corresponding connection surface of the first mount member 120. A plurality of snap connectors is optionally formed on the second major surface to define a second connection surface and a second connection direction opposite to the first connection surface.

The first connection surfaces of the first and second lateral portions 144, 146 collectively define a connection surface of the second mount member 140. A connection surface herein is also referred to as a coupling surface. The snap connectors on the first connection surfaces of the first and second lateral portions 144, 146 collectively define a connection means of the second mount member. The connection means on the first connection surfaces of the first and second lateral portions 144, 146 comprises snap connectors of the same mating type, which in this example is of the male type. In some embodiments, the connection means on the first connection surfaces of the first and second lateral portions 144, 146 comprises snap connectors of different or opposite mating types.

When connection means on the first surfaces of the first mount member 120 and the second mount member 140 are snap connected by means of snap engagement of the connection surfaces on the corresponding first connection surfaces of the corresponding mount member 120, the first peripheral wall 125 and the second peripheral wall 145 are joined to form a building block mount, as depicted in FIG. 1A1. The corresponding connection means on the first surfaces of the first mount member 120 and the second mount member 140 are referred to as internal connection means as they form part of the internal connection structure of the building block mount 100. To form the building block mount 100, the first mount member 120 and the second mount member 140 are aligned with the corresponding connection surfaces facing each other, the connection means aligned and then urged together to form a press fitted assembly.

The building block mount 100 comprises a building block receptacle having a receptacle wall and a receptacle axis. The receptacle wall defines a receptacle bore which extends in an axial direction along the receptacle axis and defines a receptacle aperture at each axial end of the building block receptacle. The receptacle wall is formed by joining the peripheral walls of the bridging portions of the first mount member 120 and the second mount member 140 with their corresponding first connection surfaces in press fit. The peripheral walls of the bridging portions of the first mount member 120 and the second mount member 140 in this example have the same axial extent in the axial direction of the receptacle axis and the axial ends of the peripheral walls are aligned or flush. The receptacle axis is a centre axis of the receptacle and extends through a geometric centre of the building block receptacle in a direction orthogonal to the connection direction of the first mount member 120 and the second mount member 140. The geometric centre of the building block receptacle is on a radial plane which is orthogonal to the receptacle wall. The building block receptacle has an axial extent and the axial extent is defined by the axial extent of the peripheral walls of the bridging portions. The building block receptacle defines a receptacle compartment which is formed by combining the partial receptacle compartments of the first mount member 120 and the second mount member 140 when the first mount member 120 and the second mount member 140 are connected in a direction orthogonal to the receptacle axis, that is, connected in the connection direction of the connection means of the first mount member 120 and the second mount member 140. The first connection surfaces of the first mount member 120 and the second mount member 140 are joined at a connection plane which is parallel to the receptacle axis. The connection plane is also referred to herein as a joining plane.

The building block mount 100 comprises a pair of lateral protrusions. Each lateral protrusion projects laterally away from the receptacle and the receptacle wall and appears as a wing portion or a wing member of the building block mount 100. Each lateral protrusion is formed by the corresponding lateral members of the first mount member 120 and the second mount member 140 in the connection direction, and has a combined thickness of the corresponding lateral members, the thickness being measured in the connection direction.

The pair of lateral protrusions comprises a first lateral projection and a second lateral projection. The first lateral projection projects away from the receptacle in a first direction and the second lateral protrusion projecting away from the receptacle in a second direction opposite to the first direction and orthogonal to the receptacle axis.

In this example, the centre axis of the receptacle, i.e., the receptacle axis, is on the connection plane and the receptacle wall is substantially symmetrical about the joining plane. The connection plane divides the building block receptacle into two receptacle portions, namely, a first receptacle portion which is defined by the first mount member 120 and a second receptacle portion which is defined by the second mount member 140. In this example, the first receptacle portion and the second reception portion are symmetrical about the connection plane.

Optional connection means such as snap connectors are formed in the exterior surfaces of the lateral wing members for snap connection with other building blocks. The optional connection means are external connection means for making mechanical connection with external building block or building block components. The example optional connection means comprises male snap connectors, but may comprise female snap connector or both male and female connectors without loss of generality.

The building block mount 100 comprises a retention means for retaining a building block or a building block stack in the building block receptacle. The example retention means is in the form of an internal anchoring means formed on the receptacle wall, as shown in FIG. 1A1. The example anchoring means is a snap connector which is formed by joining a first partial snap connector 127 and a second partial snap connector 147 along a partitioning plane which is parallel to the connection plane and parallel to the coupling axis of the snap connector. The example partitioning plane of the example snap connector is a bisecting plane containing the coupling axis of the snap connector, as depicted in FIGS. 1A2. In this example, the retention means comprises a pair of male snap connectors projecting from the receptacle wall and extending towards the receptacle axis. In some embodiments, the retention means comprises female snap connectors or a combination of male and female snap connectors.

In this example, a male snap connector of the retention means is formed by combining two partial male snap connectors. In some embodiments, the retention means may comprises a plurality of complete male snap connectors, a plurality of female snap connectors, a plurality of combined male snap connectors, a plurality of combined female snap connectors, or a combination of any of the aforesaid connectors with loss of generality.

The example building block stack 1000 comprises a first building block 1000A and a second building block 1000B in a stacked and interconnected relationship, as depicted in FIGS. 1C and 1C1.

Referring to FIGS. 1C and 1C1, the first building block 1000A and the second building block 1000B are identical building blocks. The building block 1000A, 1000B comprises a main body 1002, a first panel defining a first surface 1004 on a first side of the main body 1002, a second panel defining a second surface 1006 on a second side of the main body which is parallel to the first surface but facing in an opposite direction away from the first surface, and a peripheral wall 1008. The first surface and the second surface are square and have same dimensions. The peripheral wall 1008 interconnects the first surface 1004 and the second surface 1006 and defines an internal compartment in cooperation with the first panel surface 1004 and the second panel surface 1006.

A plurality of snap connectors 1014 is formed on the first surface 1004 and a plurality of snap connectors 1016 is formed on the second surface 1006. Each snap connector has a connector axis, which is also known as a coupling axis. The snap connectors on the first surface 1004 are distributed on four corners of a square with their coupling axes parallel and the snap connectors on the second surface 1006 are also distributed on the same four corners of the square with their coupling axes parallel so that a snap connector on the first surface has a corresponding snap connector on the second surface with their coupling axes aligned. The snap connectors on the first surface collectively define a first connection surface having a first connection direction parallel to the coupling axis of the individual snap connectors on the same surface. The snap connectors on the second surface collectively define a second connection surface having a second connection direction parallel to the coupling axis of the individual snap connectors on the same surface, and the second connection direction is parallel to but opposite to the first connection direction. In this example, the snap connectors on the first surface are male connectors and the snap connectors on the second surface are female connectors. A male snap connector on the first surface and a female snap connector on the second surface of the building block 1000A, 1000B in this example are matched snap connectors having matched dimensions and opposite or complementary mating features.

The building block 1000A, 1000B comprises a plurality of connector formations which is form on sides and corners of the first surface 1004 and on sides and corners of the second surface 1006. The connector formation in this example is in an example form of a partial snap connector. A connector formation on a side of the first surface 1004 or a side of the second surface 1006 is at mid-way between adjacent corners as an option to facilitate flexible snap connector formation. A connector formation herein is for making mechanical coupling with the anchoring means and will be referred also as a coupling formation.

When the building blocks 1000A, 1000B are stacked with the corresponding snap connectors on the corresponding connection surfaces in snap fit engagement, the first (or top) connection surface 1004 of the second building block is in abutment with the second (or bottom) connection surface 1006 of the first building block. When the building blocks 1000A, 1000B are so stacked, the partial snap connections on the first (or top) connection surface 1004 of the second building block 1000B and the partial snap connections on the second (or bottom) connection surface 1006 of the first building block 1000A cooperate to define a plurality of snap connectors, or more exactly complete snap connectors.

Referring to FIG. 1, the building block mount 100 is mounted onto the building block stack 1000, with the anchoring means of the building block mount 100 aligned and engaged with the snap connectors formed on sides of the building block stack 1000. When the building block mount 100 is mounted is so mounted, the building block stack 1000 is retained inside the building block receptacle of the building block mount 100, and the anchoring means prevents the building block stack 1000 from sliding along the building block receptacle.

To facilitate effective mounting, the building block receptacle and the building block stack 1000 are complementary, such that the receptacle wall of the building block receptacle and the side walls of the building block stack 1000 are in closely fitted abutment.

When the building block receptacle and the building block stack 1000 are in closely fitted engagement, the building block mount 100 is securely on the building block stack 1000, and the assembly as a structure can be used to support other building blocks or building block assembly through interconnection with the building block mount 100.

An example coupling formation in the form of a coupling recess 1018 or a coupling indentation, as depicted in FIGS. 1C and 1C1. The example coupling formation is formed as a corner cut-out which extends between a connection surface 1004, 1006 and a peripheral wall of the building block adjoining the connection surface.

The coupling formation extends obliquely into the main body to define a coupling recess or a coupling indentation which extends across the connection surface 1004, 1006 and the peripheral wall. The coupling recess or coupling indentation is defined by a coupling seat which is shaped to receive a counterpart coupling device of compatible shape and dimensions. The coupling recess or the coupling indentation is a reception compartment defined by the coupling seat, which is an interior peripheral wall. The example coupling formation defines a coupling seat having a concave surface inside the main body to receive a convex portion of a counterpart coupling device in abutment contact or in a closely fitted manner. The concave surface is a concave surface of a partial sphere (or a partially spherical concave surface) or a spherical cone and the convex surface of the counterpart coupling device is a convex surface of a partial sphere (or partially spherical convex surface) or a spherical cone in this example. More specifically, the concave surface defines a concave surface of spherical cone having a cone angle of slightly larger than 90 degrees, that is 90 degrees +Δ, with the centre of sphere located inside the main body, where a cone angle of 90 degrees is a cone angle of a quarter sphere, and A is a small angle of say between 5 to 10 or 15 or 20 degrees as a convenient example. In general, A can be more or less than 4 degrees, more or less than 6 degrees, more or less than 8 degrees, more or less than 10 degrees, more or less than 12 degrees, more or less than 14 degrees, 15 degrees or less, or a range or any ranges defined by a combination of any of the aforesaid values.

The example coupling formation defines an access aperture on the connection surface, on the peripheral wall of the building block 1000A, 1000B, and on the corner formed by intersection of the connection surface and the peripheral wall of the building block. The internal boundary of the access aperture (that is, boundary inside the main body) is defined by a circular arc of a circular sector, with the concave arc facing the corner. The circular arc has a corresponding central angle or a sector angle of more than 180 degrees, and more specifically approximately 180+2Δ degrees. The circular arc on the connection surface is symmetrically disposed about a plane which is orthogonal to the peripheral wall and containing a centre line of the arc is orthogonal to connection surface on which the coupling formation is formed. The centreline is located midway between two ends of the coupling formation on the connection surface. The maximum depth of the recess on the connection surface, measured with respect to the outward facing surface of the peripheral wall, is approximately the radius of the circular plus a depth defined by angle Δ due to symmetry about the centreline.

The coupling formation defines an access aperture on the connection surface, on the peripheral wall and on the edge or corner of the peripheral wall on which the coupling formation is formed. The internal boundary of the access aperture (that is, the boundary inside the main body of the building block) is defined by a circular arc of a circular sector and with the concave arc facing the edge or corner. The circular sector has a central angle or a sector angle of larger than 180 degrees, and more specifically approximately 180+2Δ degrees, and the circular sector is symmetrically disposed about a centre line which is orthogonal to the peripheral wall on which the coupling formation is formed. The centreline is located midway between the two ends of the coupling formation on the peripheral wall on which the coupling formation is formed. The maximum depth of the recess on the peripheral wall from the side of formation of the coupling formation is approximately the radius of the circular plus a depth defined by angle Δ due to symmetry about the centreline.

Due to the coupling formation, and more particularly the access apertures, a matched counterpart coupling device can enter the coupling recess or the coupling indentation at different angles, for example, in a direction orthogonal to the connection surface, in a direction orthogonal to the peripheral wall, or at an oblique angle to both the connection surface and the peripheral wall.

When an assembly of building blocks is formed by stacked connection of a pair of building blocks having corresponding coupling formations on corresponding corners on their connection surfaces, and with the corresponding connection surfaces in abutment contact, the corresponding coupling formations cooperate to define a snap connector, which is the present example is a female snap connector having a coupling axis orthogonal to the constituting peripheral walls. On the other hand, when a pair of the building blocks are connected in a side by side manner with the coupling formations bearing peripheral walls in abutment contact, the corresponding coupling formations will cooperate to define a snap connector having a coupling axis orthogonal to the connection surface on which the coupling formation is formed.

The coupling formation may comprise a first arcuate portion and a second arcuate portion which are oppositely facing. Each one of the first and second arcuate portions is a concave portion such as a concave spherical sector or a concave bracket which extends inwardly from an edge where the access apertures is formed. The concavely curved first and second arcuate portions cooperate to define a reception compartment having a narrowed entry aperture at the edge. The clearance which is defined between the oppositely facing first and second arcuate portions gradually increases from that at the edge to a maximum clearance inside the main body. In some embodiments, the clearance gradually decreases from the maximum as it extends further into the main body. In some embodiments, the first and second arcuate portions are laterally symmetrical or mirror symmetrical about a centreline of the coupling formation which is orthogonal to the edge.

With a reception compartment having a larger internal clearance inside the main body than at the access aperture, a matched male connector having a larger coupling head portion than its neck portion may have its head portion retained inside the reception compartment and its neck portion engaged by the edge or corner. To release a retained male connector, a user on overcoming the snap engagement can remove the retained male connector.

While the example coupling formation defines a reception compartment having an interior geometry of a partial sphere, the reception compartment may have other shapes without loss of generality.

While the example coupling formation defines a reception compartment so that a snap connector formed by combination of the coupling formations is a female snap connector, the coupling formation may be a protrusion or a protruding member similar to the partial male snap connector of the retention means on the building block receptacle, and a snap connector formed by combination of the coupling formations can be a male snap connector without loss of generality.

To assemble the assembly 100, a user is to bring a mount member 120, 140 towards one peripheral surface of the building block stack 1000, with the internal surface 125A, 145A of the bridging portion oppositely facing the outer peripheral wall 1008 and the internal anchoring means on the mount member aligned with a snap connector on the building block stack 1000. Next, the user is to bring another mount member 140, 120 towards an opposite peripheral surface of the building block stack 1000 in a similar manner, and then to press connect the first and second mount members 120, 140.

When the first and second mount members 120, 140 are aligned and pressed joined, the building block mount 100 will clamp on to the building block stack 1000 and provides a support base for connection with an external building block, external building blocks, an external building block connector or external building block connectors without loss of generality. Likewise, the building block stack can form a support basis to the building block mount to support other building blocks or structures.

When the building block mount 100 is duly clamped onto a building block or a building block assembly, mechanical interaction between the internal anchoring means of the building block mount 100 and the retention means on the building block stack 1000 would operate to retain the building block mount 100 at a fixed relative axial level with respect to the building block stack and prevents relative sliding movement in the axial direction of the receptacle axis.

In this example, the receptacle wall of the building block receptacle closely follows the outside peripheral profile of the building block. In this example, the building block has a square outer peripheral profile in a radial direction orthogonal to the receptacle axis and receptacle wall of the building block receptacle has a correspondingly matched square shape. The matched shape promotes more even and distributed support of the building block mount on its support basis, that is, the building block stack. In some embodiments, the receptacle wall of the building block receptacle may not be in full abutment contact with all the peripheral surfaces of the building block stack, but may have a plurality of abutment contact support locations and a plurality of non-contact locations. The non-contact locations may be intentional to provide passage channels for components, for example, wires, cables or connecting rods, to rise through.

While a building block stack has been depicted to form the building block assembly 10, a single building block may also be retained by a building block mount according to the disclosure. For example, the building block mount can mount on to a building block comprising a plurality of integrally formed snap connectors distributed in its outer peripheral surface without loss of generality.

In this example, the joining plane is also a dividing plane dividing the square building block receptacle into two rectangular portions, and more specifically, into two equal symmetrical halves. In some embodiments, the dividing plane may divide the building block receptacle into unequal or non-symmetrical portions.

In this example, the joining plane (the dividing plane or the pair of lateral members) is at right angle to the peripheral wall. In some embodiments, the joining plane (the dividing plane or the pair of lateral members) is at non-right angle to the peripheral wall.

In this example, the external connection means comprises a plurality of external connectors. The example external connectors are male snap connectors. In some embodiments, the external connectors may be female snap connectors, non-snap connector, a combination of both snap connectors and non-snap connectors, or a combination of both male and female snap connectors without loss of generality.

In this example, the external connection means is configured to enter into coupling connection with external connectors along a connection direction of the mount members. In some embodiments, the external connection means may be configured to enter into coupling connection with external connectors at an angle to the connection direction of the mount members.

In this example, the external connection means is formed on an outer surface of the mount member, for example, on the projecting wings or on the outward facing surface of the bridging portion of the mount member, and projects orthogonally from its base surface. In some embodiments, an external connector of the external connection means may have its coupling axis at an angle and non-orthogonal to its base surface from which the connector projects.

In the example, the building block receptacle defined by the mount has a square or rectangular boundary surrounding the centre axis of the receptacle. In some embodiments, the building block receptacle may have a circular, oval, rounded, or polygonal boundary profile without loss of generality.

An example building block structure 10' comprises an example building block assembly 100' detachably mounted on an example building block 1000', as depicted in FIG. 1B. The building block assembly 100' comprises a first building block 120' and a second building block 140'. The building block assembly 100' is configured as a building block mount and will be so referenced. The first building block 120' is referred to as a first mount member and will share the same reference numeral as the first building block and the second building block 140' is referred to as a second mount member 140' and will share the same numeral as the second building block for ease of reference. Likewise building block assembly 100' and building block mount will share the same reference numeral for ease of reference.

The first building block 120' comprises a main body which comprises a bridging portion 122', a first lateral portion 124' and a second lateral portion 126'. The bridging portion 122' is intermediate the first lateral portion 124' and the second lateral portion and interconnects the first lateral portion 124' and the second lateral portion 126'. In this embodiment, the bridging portion 122', the first lateral portion 124' and the second lateral portion 126' are coplanar and are integrally formed on a panel member.

The first building block 120' is substantially identical to the first building block 120, apart from having a pair of longer lateral wall portions on the bridging portion 122', a plurality of female snap connectors 127' on the bridging portion, and an external connection means comprising a plurality of female snap connectors. Apart from the aforesaid modifications, the features of the mount 100' are substantially identical to that of the mount 100 and the description thereon is incorporated by reference and applied mutatis mutandis for succinctness, with like numerals representing like features but appended with an apostrophe.

The second building block 140' comprises a main body which comprises a bridging portion 142', a first lateral portion 144' and a second lateral portion 146'. The bridging portion 142' is intermediate the first lateral portion 144' and the second lateral portion and interconnects the first lateral portion 144' and the second lateral portion 146'. In this embodiment, the bridging portion 142', the first lateral portion 144' and the second lateral portion 146' are coplanar and are integrally formed on a panel member.

The panel member includes a first major surface and a second major surface which is opposite facing to the first major surface. A plurality of snap connectors is formed on the first major surface to define a first connection surface and a first connection direction. The first connection surface is for entering into snap engagement with a corresponding connection surface of the second mount member 140'. A plurality of snap connectors is optionally formed on the second major surface to define a second connection surface and a second connection direction opposite to the first connection surface. The snap connectors distributed on the first connection surface of this second mount member 140' collectively define an internal connection means as they are configured for making engagement with corresponding connectors on the first connection surface of the first mount member 140' and form part of the internal connection structure of the building block mount 100'.

When the first mount member 120' and the second mount member 140' are connected at their first connection surfaces, the building block mount 100' is formed and a building block receptacle is defined. In this example, the receptacle is not symmetrical about the joining plane formed by conjoining the first connection surfaces of the first mount member 120' and the second mount member 140' and the receptacle axis is not on the joining plane, otherwise, the receptacle is identical to that of the building block mount 100 and the description thereon is incorporated herein by reference, with like numerals representing like features but appended with an apostrophe.

In this embodiment, the structure 10' comprises the building block mount 100' and a single building block 1000', with the single building block 1000' retained by the building block receptacle. The building block 1000' comprises male snap connectors (not shown) on its peripheral walls which project into the female snap connectors formed on the receptacle wall as retention means.

To assemble the assembly 100', a user is to plug a first mount member 120' onto the building block 1000', with the male snap connector on the building block 1000' aligned with the female snap connector on the first mount member 120'. Next, the user is to bring a second mount member 140' towards the connection surface of the first mount member 120', and then to press connect the first and second mount members 120', 140'.

An example building block structure 10" comprises an example building block assembly 100" detachably mounted on an example building block stack 1000", as depicted in FIG. 1D. The building block stack 1000" comprises a plurality of building blocks of different shapes, comprising two square building blocks 1000"A and three rectangular building blocks 1000"B. Apart from the aforesaid modifications, the features of the building block stack 1000" are substantially identical to that of the building block stack 1000 and the description therein is incorporated by reference and applied mutatis mutandis for the benefit of succinctness.

The building block assembly 100" comprises a first building block 120" and a second building block 140". The building block assembly 100" is configured as a building block mount and will be so referenced. The first building block 120" is referred to as a first mount member and will share the same reference numeral as the first building block 120 and the second building block 140" is referred to as a second mount member 140" and will share the same numeral as the second building block 140 for ease of reference.

Each of the building block 120", 140" is substantially identical to the first building block 120' and the description thereon is incorporated by reference and applied mutatis mutandis for succinctness, with like numerals representing like features but appended with an additional apostrophe. The building block mount 100' is formed by connecting the first building block 120" and the second building block 140" and the description on the receptacles herein is incorporated by reference and applied mutatis mutandis for succinctness.

An example building block mount 200 depicted in FIGS. 2A and 2A1 is formed by connecting tow identical building blocks 220. The building block 220 is substantially identical to the first building block 120, except that the joining plane extends along a diagonal of the building block receptacle, the internal connection means on the first connection surface comprises both male and female snap connector, and the external connection means comprises both male and female snap connector. In this example, female type external connection means is formed on the receptacle wall 225. Apart from the aforesaid modifications, the features of the mount 200 are substantially identical to that of the mount 100 and the description thereon is incorporated by reference and applied mutatis mutandis for the benefit of succinctness, with like numerals representing like features but increased by 100.

An example building block mount 300 depicted in FIGS. 3A, 3A1 and 3A2 is substantially identical to that of the mount 100, 100', 100", 200 and the description thereon is incorporated by reference and applied mutatis mutandis for the benefit of succinctness.

In this embodiment, a window is opened on the peripheral wall of the mount member and corresponding windows on the corresponding peripheral walls of the first and second mount member define a through passageway or through passage window. As the example window is rectangular, a through passageway having a rectangular boundary is formed, and the passageway extends in a direction orthogonal to the central axis of the building block receptacle.

An example building block mount 400 depicted in FIGS. 4A, 4A1 and 4A2 is substantially identical to that of the mount 100, 100', 100", 200, 300 and the description thereon is incorporated by reference and applied mutatis mutandis for the benefit of succinctness. In this embodiment, the peripheral wall has a rounded or substantially circular profile to define a building block receptacle having a rounded or circular boundary internal profile. Apart from the circular or rounded internal boundary profile, the features of the mount 100, 200, and 300 are common and the description thereon is incorporated by reference.

An example building block mount 500 depicted in FIGS. 5A, 5A1 and 5A2 is substantially identical to that of the mount 100 and the description thereon is incorporated by reference and applied mutatis mutandis for the benefit of succinctness. In this embodiment, the peripheral wall has a rounded or substantially circular profile to define a building block receptacle having a rounded or circular boundary internal profile. Apart from the circular or rounded internal boundary profile, the features of the mount 100, 100', 100", 200, 300, and 400 are common and the description thereon is incorporated by reference. In addition, end connectors are formed on two lateral portions of the building block receptacle. Each of the end connectors has a coupling axis which defines a coupling direction and the coupling axis is on the joining plane. In this example, the coupling directions are different and at an angle to the centre axis of building block receptacle, and at an angle to each other.

An example building block mount 600 depicted in FIGS. 6A, 6A1 and 6A2 is substantially identical to that of the mount 500 except that an end connector is formed on an edge of the peripheral wall, and the description thereon is incorporated by reference and applied mutatis mutandis for the benefit of succinctness.

An example building block mount 700 depicted in FIGS. 7A, 7A1 and 7A2 is substantially identical to that of the mount 600 except that an end connector is formed on an edge of the peripheral wall, and the description thereon is incorporated by reference and applied mutatis mutandis for the benefit of succinctness.

In this embodiment, a window is opened on the peripheral wall of the mount member and corresponding windows on the corresponding peripheral walls of the first and second mount member define a through passageway or through passage window. As the example window is rectangular, a though passageway having a rectangular boundary is formed, and the passageway extends in a direction orthogonal to the central axis of the building block receptacle.

An example assembly depicted in FIG. 8 comprises a mount 600 received inside the building block receptacle of a mount 700, with the axes of the respective building block receptacles aligned. With the two building block mounts 600, 700 in a coaxial relationship and mounted on a building block having a circular cross-section, the first mount and the second mount are relatively rotatable with respect to each other. In some embodiments, the first mount and the second mount are also relatively rotatable with respect to the building block passing through the building block receptacles. With the relative rotatable mounts, the external connectors thereon can be adapted for connection at a plurality of angular orientation and provides great flexibility.

A structure constructed from a plurality of building blocks, building block connectors and building block mounts is depicted in FIG. 9. As depicted in FIG. 9, the building block on which the mounts are clamped extend along the centre axis of a respective building block receptacle.

An example building block structure 90 comprises an example building block assembly 900 detachably mounted on an example building block 2000, as depicted in FIG. 10. The building block assembly 900 comprises a first building block 920 and a second building block 940, as depicted in FIGS. 10A, 10B1, 1062, 1001, 1002. The example building block 2000 is a building block comprising a cylindrical body having helical threads formed on its outer cylindrical surface.

The building block assembly 900 is to operate as a building block mount in this example and will be so referenced. The first building block 920 is referred to as a first mount member and will share the same reference numeral as the first building block 120 and the second building block 940 is referred to as a second mount member 940 and will share the same numeral as the second building block 140 for ease of reference.

The first building block 920 comprises a main body which comprises a bridging portion 922, a first lateral portion 924 and a second lateral portion 926. The bridging portion 922 is intermediate the first lateral portion 924 and the second lateral portion 926 and interconnects the first lateral portion 924 and the second lateral portion 926. The bridging portion 922 comprises a peripheral wall which is shaped to define a first partial receptacle compartment. The first partial receptacle compartment is a partial cylindrical compartment and peripheral wall includes an inner peripheral surface which faces the first partial receptacle compartment and an outer peripheral surface which faces away from the partial receptacle compartment. The inner peripheral surface is threaded with a first set of partial helical threads. The helical threads extend along a direction which is substantially orthogonal to the cylindrical axis of the first partial cylindrical compartment and the cylindrical axis is also a centre axis of the helical threads.

The first lateral portion 924 comprises a first lateral member which extends away from the bridging portion 922 and from the partial receptacle compartment. The example first lateral member is in the form of a panel member and includes a first major surface and a second major surface which is opposite facing to the first major surface. A plurality of snap connectors is formed on the first major surface to define a first connection surface and a first connection direction. The first connection surface is for entering into snap engagement with a corresponding connection surface of the second mount member 940. A plurality of snap connectors is optionally formed on the second major surface to define a second connection surface and a second connection direction opposite to the first connection surface.

The second lateral portion 926 comprises a second lateral member which extends away from the bridging portion and from the partial receptacle compartment. The direction of extension of the second lateral portion 926 is opposite to that of the first lateral portion 924. The example second lateral member is also in the form of a panel member and includes a first major surface and a second major surface which is opposite facing to the first major surface. A plurality of snap connectors is formed on the first major surface to define a first connection surface and a first connection direction. The first connection surface is for entering into snap engagement with a corresponding connection surface of the second mount member 940. A plurality of snap connectors is optionally formed on the second major surface to define a second connection surface and a second connection direction opposite to the first connection surface.

The snap connectors formed on the first connection surfaces of the first and second lateral members are internal connectors to facilitate connection between the first and second connection members and the internal connectors collectively define an internal connection means, as described herein before and the description there on is incorporated by reference.

The second building block 940 comprises a main body which comprises a bridging portion 942, a first lateral portion 944 and a second lateral portion 946. The bridging portion 942 is intermediate the first lateral portion 944 and the second lateral portion and interconnects the first lateral portion 944 and the second lateral portion 946. The bridging portion 922 comprises a peripheral wall which is shaped to define a second partial receptacle compartment. The second partial receptacle compartment is a partial cylindrical compartment and peripheral wall includes an inner peripheral surface which faces the second partial receptacle compartment and an outer peripheral surface which faces away from the partial receptacle compartment. The inner peripheral surface is threaded with a second set of partial helical threads. The helical threads extend along a direction which is substantially orthogonal to the cylindrical axis of the second partial cylindrical compartment and the cylindrical axis is also a centre axis of the helical threads.

The second building block 940 is generally a mirror reflection of the first building block 920, except that and the internal connection means on its first connection surfaces are aligned and matched with the internal connection means of the first building block. The descriptions on the first building block 920 is incorporated by reference and applied mutatis mutandis for succinctness.

When the first building block 920 and the second building block 940 are connected via their respective surfaces, a building block receptacle with a cylindrical internal bore and having helical threads winding around the internal bore with the cylindrical axis as the thread axis is formed. The helical threads functions as an example of the aforesaid retention means to resist sliding movement of the threaded cylindrical building block.

A first building block and a second building block connectable to form a building block assembly for mounting on a third building block is disclosed. The first building block comprises a first main body including two lateral portions and a first bridging portion interconnecting the two lateral portions and a first connection means formed and distributed on the two lateral portions defining a first connection surface and a first connection direction. The second building block comprises a second main body including two lateral portions and a second bridging portion interconnecting the two lateral portions and a second connection means formed and distributed on the two lateral portions defining a second connection surface and a second connection direction. The first connection means and the second connection means are matched and compatible connection means in releasable mechanical snap engagement to form the assembly and the first bridging portion and the second bridging portion cooperate to define a building block receptacle having a receptacle wall and a receptacle axis. The building block receptacle is for receiving a third building block and comprises a retention means on the receptacle wall. The retention means is to resist sliding movement of the third building block relative to the building block receptacle, the assembly, the first building block and/or the second building block in an axial direction defined by the receptacle axis of the building block receptacle.

The first connection means and the second connection means are matched and compatible snap connection means which are snap fastened in a connection direction to snap connect or snap fasten the first building block and the second building block to form the assembly, the connection direction being aligned with the first connection or the second connection direction.

The first connection means comprises a plurality of connectors which is distributed on the two lateral portions of the first main body and the second connection means comprises a plurality of connectors which is distributed on the two lateral portions of the second main body.

In some embodiments, the first building block and the second building block are identical building blocks or building blocks having identical connection surfaces, that is the first connection surface and the second connection surface are identical.

In some embodiments, the connection surface of the first building block and/or the second building block is symmetrical about a plane of symmetry so that two first building blocks or two second building blocks are connectible to form an assembly.

In some embodiments, the connection means on a connection surface of the first building block and/or the second building block comprises a plurality of complementary snap connectors and the complementary snap connectors are symmetrically disposed about a or the plane of symmetry so that two first building blocks or two second building blocks are connectible to form an assembly and are connected when the complementary snap connectors on the connection surfaces on the building blocks forming the assembly are in snap engagement.

In this specification, a singular term is not confined to a singular meaning and may extend to a plural meaning where the context permits or appropriate for succinctness. Likewise, a plural term is not confined to a plural meaning and may include a singular meaning where the context permits or appropriate for succinctness.

While the disclosure has been made with reference to examples and embodiments, the examples and embodiments are non-limiting and shall not be used to restrict the scope of disclosure.

While the disclosure has made reference to various embodiments, the embodiments are for example and should not be used to limit restrict the scope of the disclosure.

For example, the example building blocks herein are toy building blocks for toy or toy-like applications and the building block assemblies are toy or toy-like building block assemblies. However, the building blocks herein can also be non-toy building blocks such as machine building blocks, construction building blocks such as tiles or bricks, and/or other industrial building blocks and the building block assemblies are modular built machines or machine parts, modular built structures, modular built structure parts, modular built structural parts, modular built fixture and/or fixture parts and/or fixture sub-assemblies.

When used for toy applications as toy assemblies, the component building blocks have a typical radial extent (or width, or lateral extent) of between 1 cm and 15 cm and a typical axial extent (or thickness) or between 0.3 mm for a miniature block to 5 cm. For example, the radial extent can be, in units of cm, 1 for a miniature block, 1, 1.5, 2, 2.5, 3.5, 4, 4.5, 5, 5.5, 6, 6.5, 7, 7.5, 8, 8.5, 9, 9.5, 10, 10.5, 11, 11.5, 12, 12.5, 13.5, 14, 14.5, 15, 15.5, 16, 16.5, 17, 17.5, 18, 18.5, 19, 19.5, 20, or more for a mega block, or a range or any ranges formed by a selected combination of any of the aforesaid values as limits of a range or limits of ranges. For example, the axial extent can be, in units of cm, 1 for a miniature block, 1, 1.5, 2, 2.5, 3.5, 4, 4.5, 5, 5.5, 6, 6.5, 7, 7.5, 8, 8.5, 9, 9.5, 10, or more for a mega block, or a range or any ranges formed by a selected combination of any of the aforesaid values as limits of a range or limits of ranges.

When for industrial uses, for example for modular construction of machines, buildings, structures, parts, the aforesaid values may be scaled up, in unit of times, by 10, 20, 30, 40, 50, 60, 70, 80, 90, 100, 110, 120, or a range or any ranges formed by a selected combination of any of the aforesaid values as limits of a range or limits of ranges; and the component building blocks may be made of strong thermoplastics, carbon fibres, fibre glass, or metals, or other mouldable materials, having a high rigidity and a small degree of resilience.

While assemblies of the building blocks have been described with reference to snap engagement or snap connection and snap connectors, the building blocks may be joined or connected by other press-fit mechanisms or methods without loss of generality.

While the example connectors described and depicted herein are snap connectors adapted for making snap-fit engagement, a connector herein can be a "press-fit" connector for making press-fit engagement or a "friction-fit for making press-fit engagement unless the context requires otherwise.

In general, a snap-fit connector comprises an engagement portion having snap-fit mating features. The terms "snap", "snap fit", and "snap-fit", are interchangeably used herein unless the context requires otherwise. The terms "fastener" and "connector" are also interchangeably used herein unless the context requires otherwise. In this description and specification, and when in relation to a connector or an engagement portion having a coupling axis, the terms "closely-fitted engagement" and "coupled engagement" are interchangeable, the axial direction is with respect to the coupling axis and the axial direction is along the coupling axis, and the radial direction is with respect to the coupling axis and the radial extent is in the radial direction, unless the context requires otherwise.

The words "first", "second", "third", "fourth", etc. are generic terms for ease of reference only and are not intended for indicate priority, order or sequence unless the context requires otherwise or specifies otherwise. Where there are conflicts in relation to the aforesaid generic terms, the conflicts are to resolve to give a meaning which is reasonable for interpretation where possible.

While singular and plural terms are used herein, a singular term may apply mutatis mutandis to a plural situation and a plural term may apply mutatis mutandis to a single situation where the context permits or requires.

Table of numerals

| | | | | | |
|---|---|---|---|---|---|
| 10 | Building block structure | | | | |
| 1000 | Building block stack | 1000A | First building block | 1000B | Second building block |
| 1002 | Main body | 1004 | First surface | 1006 | Second surface |
| 1008 | Peripheral wall | 124 | First lateral portion | 126 | Second lateral portion |
| 100 | Building block assembly, building block mount | 125A | Internal surface, inner peripheral surface | 125B | External surface |
| 120 | First building block, first mount member | 125j | First lateral wall portion | 125k | Second lateral wall portion |
| 122 | Bridging portion | 144 | First lateral portion | 146 | Second lateral portion |
| 125 | First peripheral wall | 145A | Inner peripheral surface | 145B | External surface |
| 125i | Intermediate wall portion | 145j | First lateral wall portion | 145k | Second lateral wall portion |
| 140 | Second building block, second mount member | | | | |
| 142 | Bridging portion | | | | |
| 145 | First peripheral wall | | | | |
| 145i | Intermediate wall portion | | | | |

The invention claimed is:

1. A building block assembly comprising a first building block and a second building block which are in snap-fit engagement and which cooperate to define a building block receptacle for receiving and retaining a third building block, wherein the first building block comprises a first main body including two lateral portions and a bridging portion interconnecting the two lateral portions, wherein the two lateral portions and the first bridging portion cooperate to define a first partial receptacle having a first partial receptacle wall, and the two lateral portions cooperate to define a first connection surface on which a plurality of snap connectors is distributed;

wherein the second building block comprises a second main body including two lateral portions and a bridging portion interconnecting the two lateral portions, wherein the two lateral portions and the second bridging portion cooperate to define a second partial receptacle having a second partial receptacle wall, and the two lateral portions cooperate to define a second connection surface on which a plurality of snap connectors is distributed;

wherein the first partial receptacle wall and the second partial receptacle wall cooperate to define a building block receptacle, the building block receptacle having a receptacle wall and a receptacle axis defining an axial direction;

wherein the plurality of snap connectors on the first connection surface and the plurality of snap connectors on the second connection surface are in releasable snap engagement; and wherein the first connection surface and the second connection surface are opposite facing surfaces; and wherein retention means configured to resist sliding movement of the third building block in an axial direction relative to the building block receptacle are formed on the receptacle wall.

2. The building block assembly of claim 1, wherein the first connection surface and the second connection surface are in abutment and cooperate to define a connection plane, and wherein the connection plane divides the building block receptacle into the first partial receptacle and the second partial receptacle.

3. The building block assembly of claim 1, wherein the first building block and the second building block are both made of a rigid or semi-rigid material.

4. The building block assembly of claim 1, wherein the retention means comprises two partial snap connectors which are combined to form a snap connector having a coupling axis.

5. The building block assembly of claim 4, wherein the receptacle entry defines an annular entry aperture.

6. The building block assembly of claim 4, wherein the coupling receptacle has an annular engagement portion which is configured for engaging with a male snap connector.

7. The building block assembly of claim 4, wherein the male snap connector comprises a male engagement portion having a maximum radial extent, and wherein the receptacle entry defines a radial clearance which is smaller than the maximum radial extent of the male engagement portion.

8. The building block assembly of claim 4, wherein the first connection surface and the second connection surface are in abutment and cooperate to define a connection plane, and the two partial snap connectors are joined along the connection plane.

9. The building block assembly of claim 8, wherein the connection plane is a bisecting plane of the snap connector containing the coupling axis.

10. The building block assembly of claim 1, wherein the plurality of snap connectors comprises a plurality of female snap connectors and a plurality of male snap connectors, wherein the female snap connector comprises a coupling receptacle for closely-fitted reception of a protrusion portion of a male snap connector, wherein the coupling receptacle comprises a receptacle compartment and a receptacle entry through which a male snap fastener enters the receptacle compartment; and wherein the receptacle entry defines a minimum radial clearance of the coupling receptacle.

11. The building block assembly of claim 1, wherein the plurality of snap connectors comprises a plurality of male snap connectors, wherein a male snap connector has a coupling axis defining a coupling direction and a protrusion projecting away from a base surface and extending in the coupling direction, and wherein the protrusion has a bulged head portion at an axial level with respect to the base surface.

12. The building block assembly of claim 11, wherein the protrusion has a radial extent with respect to the coupling axis, wherein the bulged head portion defines a maximum radial extent and a maximum radial plane of the protrusion, and wherein the bulged portion has a lower surface which extends between the maximum radial plane and the base surface and which is a tapered surface which oppositely faces the base surface.

13. The building block assembly of claim 12, wherein the radial extent of the lower surface of the bulged head portion increases as the axial level of the lower surface away from the base surface increases.

14. The building block assembly of claim 12, wherein the protrusion of the male snap connector comprises a neck portion interconnecting the bulged head portion and the base surface, and wherein the neck portion tapers to narrow on extending towards the base surface.

15. The building block assembly of claim 11, wherein the protrusion of the male snap connector comprises a neck portion interconnecting the bulged head portion and the base surface, and wherein the neck portion defines a channel which extends in a peripheral direction, the peripheral direction being orthogonal to the coupling direction.

16. The building block assembly of claim 15, wherein the channel is an annular channel defining a female engagement portion on the protrusion.

17. The building block assembly of claim 15, wherein the channel has a curved profile.

18. The building block assembly of claim 1, wherein the plurality of snap connectors comprises a plurality of male snap connectors and a plurality of female snap connectors, wherein a male snap connector comprises a protrusion which projects away from a base surface and extends along a coupling axis which defines a coupling direction, wherein the protrusion has a head portion and a neck portion, the neck portion defining a peripheral channel which extends in a peripheral direction orthogonal to the coupling axis, and wherein a female snap connector comprises a first receptacle portion defining a receptacle entry, and wherein the receptacle entry surrounds the neck portion of the male snap connector.

19. The building block assembly of claim 18, wherein the receptacle entry of the female snap connector snaps on the neck portion of the male snap connector.

20. The building block assembly of claim 18, wherein the female snap connector comprises a second receptacle portion which is a head receptacle portion defining a head engagement compartment, wherein the head engagement compartment comprises an enlarged compartment having a radial profile larger than the radial profile of the receptacle entry, and wherein the enlarged compartment of the head engagement compartment is configured for making snap engagement with the head portion of the protrusion.

* * * * *